US007454882B2

(12) United States Patent
Kapturowski et al.

(10) Patent No.: US 7,454,882 B2
(45) Date of Patent: Nov. 25, 2008

(54) METHODS FOR VARIABLY OPENING ENVELOPES

(75) Inventors: Edward J. Kapturowski, Apex, NC (US); Robert T. Snyder, Raleigh, NC (US); Chris Peterson, Fuquay-Varina, NC (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 11/546,556

(22) Filed: Oct. 12, 2006

(65) Prior Publication Data

US 2008/0086983 A1 Apr. 17, 2008

(51) Int. Cl.
*B65B 43/26* (2006.01)

(52) U.S. Cl. ..... 53/492; 53/381.5

(58) Field of Classification Search ..... 53/381.5–381.7, 53/569, 460, 492, 284.3
See application file for complete search history.

(56) References Cited

U.S. PATENT DOCUMENTS

| | | | |
|---|---|---|---|
| 3,207,017 | A | 9/1965 | McCain et al. |
| 3,275,118 | A | 9/1966 | McCain et al. |
| 3,545,371 | A | 12/1970 | Reist |
| 3,717,074 | A | 2/1973 | Rasmussen |
| 4,071,997 | A | 2/1978 | Gunther, Jr. et al. |
| 4,078,790 | A | 3/1978 | Stocker |
| 4,217,085 | A | 8/1980 | Ljungberg et al. |
| 4,299,073 | A | 11/1981 | Golicz et al. |
| 4,524,691 | A | 6/1985 | Miller |
| 4,604,849 | A | 8/1986 | Zemke et al. |
| 4,694,631 | A | 9/1987 | Gunther, Jr. |
| 4,694,632 | A | 9/1987 | Gunther, Jr. |
| 4,753,429 | A | 6/1988 | Irvine et al. |
| 4,775,143 | A | 10/1988 | Arnoldi et al. |
| 4,787,192 | A | 11/1988 | Gunther, Jr. |
| 4,958,063 | A | 9/1990 | Hausmann |
| 5,100,125 | A | 3/1992 | Uplinger et al. |
| 5,125,214 | A | 6/1992 | Orsinger et al. |
| 5,154,410 | A | 10/1992 | Baader et al. |
| 5,230,504 | A | 7/1993 | Schmaling |
| 5,255,498 | A | 10/1993 | Hotchkiss et al. |

(Continued)

FOREIGN PATENT DOCUMENTS

| | | |
|---|---|---|
| DE | 3409168 | 9/1985 |

(Continued)

OTHER PUBLICATIONS

Jan. 31, 2008 Extended European Search Report Communication issued in corresponding EP 07020043.1-2211.

(Continued)

*Primary Examiner*—Stephen F Gerrity
(74) *Attorney, Agent, or Firm*—Jenkins, Wilson, Taylor & Hunt, P.A.

(57) ABSTRACT

Apparatuses and methods are provided for variably opening envelopes, such as for an inserting system. A deck is provided that creates a conveying path on which insert material can travel. A feeding guide that holds open a mouth of each envelope can be attached to the deck. Based on the physical characteristics of the material to be inserted into the envelope, the deck and feeding guide are movable to control the amount that the mouth of each envelope is held open.

16 Claims, 20 Drawing Sheets

U.S. PATENT DOCUMENTS

| | | | | |
|---|---|---|---|---|
| 5,414,977 | A | | 5/1995 | Cohen |
| 5,415,068 | A | | 5/1995 | Marzullo |
| 5,417,414 | A | | 5/1995 | Belec et al. |
| 5,449,159 | A | | 9/1995 | Belec et al. |
| 5,524,417 | A | | 6/1996 | Iddon |
| 5,581,972 | A | | 12/1996 | Antonelli |
| 5,651,238 | A | * | 7/1997 | Belec et al. ..... 53/381.6 |
| 5,660,030 | A | * | 8/1997 | Auerbach et al. ..... 53/381.5 |
| 5,737,899 | A | | 4/1998 | Supron et al. |
| 5,802,808 | A | | 9/1998 | Lyga |
| 5,848,518 | A | | 12/1998 | Bufalini et al. |
| 5,860,643 | A | | 1/1999 | Moser et al. |
| 6,041,569 | A | | 3/2000 | Freeman et al. |
| 6,341,773 | B1 | | 1/2002 | Aprato et al. |
| 6,371,902 | B1 | | 4/2002 | Bluemle |
| 6,398,204 | B1 | | 6/2002 | Keane et al. |
| 6,446,955 | B1 | | 9/2002 | Janatka et al. |
| 6,615,105 | B2 | | 9/2003 | Masotta |
| 6,915,184 | B2 | | 7/2005 | Yates et al. |
| 6,957,521 | B2 | | 10/2005 | Botschek et al. |
| 7,021,184 | B2 | | 4/2006 | Sussmeier et al. |
| 7,220,093 | B2 | | 5/2007 | Overman et al. |
| 7,396,006 | B2 | | 7/2008 | Kapturowski et al. |
| 2003/0014376 | A1 | | 1/2003 | DeWitt et al. |
| 2004/0035527 | A1 | | 2/2004 | Cook |
| 2004/0255561 | A1 | | 12/2004 | Heilman |
| 2005/0189409 | A1 | | 9/2005 | Conard et al. |
| 2007/0075475 | A1 | | 4/2007 | Kapturowski et al. |
| 2007/0145659 | A1 | | 6/2007 | Kapturowski et al. |
| 2007/0164496 | A1 | | 7/2007 | Kapturowski et al. |
| 2008/0088076 | A1 | | 4/2008 | Shinn et al. |
| 2008/0088083 | A1 | | 4/2008 | Kapturowski et al. |
| 2008/0090713 | A1 | | 4/2008 | Kapturowski et al. |

FOREIGN PATENT DOCUMENTS

| | | | |
|---|---|---|---|
| DE | 3811221 | A1 | 10/1989 |
| DE | 3938530 | | 8/1990 |
| DE | 19543634 | | 5/1997 |
| DE | 10208583 | A1 | 10/2002 |
| DE | 20320537 | | 10/2004 |
| EP | 0113011 | | 7/1984 |
| EP | 0220124 | | 4/1987 |
| EP | 1911703 | | 8/2001 |
| EP | 1770042 | | 4/2007 |
| EP | 1911602 | | 4/2008 |
| EP | 1911704 | | 4/2008 |
| EP | 1911708 | | 4/2008 |
| EP | 1911710 | | 4/2008 |
| FR | 2587015 | | 3/1987 |
| GB | 2347897 | A | 9/2000 |
| GB | 2399056 | A | 9/2004 |
| JP | 61295934 | | 12/1986 |
| JP | 08207177 | | 8/1996 |
| WO | WO98/46420 | | 10/1998 |
| WO | WO 01/56712 | A2 | 8/2001 |

OTHER PUBLICATIONS

European Search Report for application EP06018903 dated Mar. 13, 2007.
Extended European Search Report for EP07017896 dated Feb. 22, 2008.
Extended European Search Report for EP07017894 dated Feb. 28, 2008.
Partial European Search Report for EP07017898 dated Feb. 13, 2008.
Office Action-non final action dated Jun. 18, 2008 for U.S. Appl. No. 11/546,552.
Office Action-non final action dated Sep. 25, 2007 for U.S. Appl. No. 11/240,604.
Notice of Allowance dated Dec. 11, 2007 for U.S. Appl. No. 11/240,604.
Patent Withdrawal Notice dated mar. 28, 2008 for U.S. Appl. No. 11/240,604.
Notice of Allowance dated Apr. 24, 2008 for U.S. Appl. No. 11/240,604.

* cited by examiner

METHODS FOR VARIABLY OPENING ENVELOPES

RELATED APPLICATIONS

This application relates to co-pending U.S. patent application Ser. No. 11/546,535, entitled "INSERTING SYSTEMS AND METHODS" filed simultaneously, the disclosure of which is incorporated herein by reference in its entirety. Further, this application relates to co-pending U.S. patent application Ser. No. 11/546,553, entitled "APPARATUSES AND METHODS FOR REGISTERING SHEET ARTICLES" and to co-pending U.S. patent application Ser. No. 11/546,555, entitled "CREASE ROLLER APPARATUSES AND METHODS FOR USING SAME," also filed simultaneously, the disclosures of which are also incorporated herein by reference in their entireties.

TECHNICAL FIELD

The subject matter disclosed herein relates generally to handling of sheet articles for processing. More particularly, the subject matter disclosed herein relates to apparatuses and methods for preparing and opening envelopes within a sheet processing machine.

BACKGROUND

Increasingly, a widespread need exists in commercial and governmental institutions for sheet processing machines, particularly mail processing machines, capable of operating at higher operation speeds with high reliabilities and short down-times. Operating sheet processing machines at or near their maximum capability is critical for optimizing output and throughput. Delays or inefficiencies in any operation in the processing of sheet articles can undesirably affect further operations downstream. Since each operation is typically synchronized to the others, delays in feeding time, as well as other operations, can be perpetuated throughout an entire sheet processing sequence or line.

Speeds and efficiencies of a sheet processing machine in high speed operations can be greatly affected by the handling of the sheet articles within the sheet processing machine. For example, demands on accuracy of sheet article positioning and alignment in the course of handling of sheet articles are greatly increased in high speed sheet or mail processing machines. False or inadequate alignment or registrations can result in misdeeds of sheet articles that can cause delays in processing.

A further example relates to processing of creased sheet articles. When processing creased sheet articles within a sheet processing machine, particular attention needs to be paid to the handling of the creased sheet articles. The crease of a sheet article can cause the sheet article to assume a non-planar position. Thus, the creased sheet article may become harder to process within a sheet processing machine. When filling an envelope within an inserting system, for example, the fold of the flap of the envelope along its hinge line often causes the envelope to assume a non-planar position, which makes handling within the inserting system more difficult. Also, the fold of the flap often causes the flap to block the mouth of the envelope. Thus, it is desirable to have the envelope assume a more planar position during processing within a sheet processing machine. Complicated mechanisms are currently used within sheet processing machines to force envelopes to assume a more planar position during processing. These mechanisms used to force envelopes to assume a more planar position during processing can slow down processing and also cause delays and inefficiencies.

Another example of where the handling of sheet articles within an inserting system can affect delays or inefficiencies relates to the filling of envelopes. The processes and apparatuses used for opening envelopes can create a bottle neck within an inserting system. Any delays or inefficiencies in such processes or apparatuses will likely affect production through the entire inserting system. Thus, any improvement in speeds or efficiencies can greatly affect production of the inserting system. For example, early steps for preparing the envelopes for insertion may be beneficial. Also, processing the envelope in a more effective manner can improve throughput of the inserting system. For instance, maximizing the amount that an envelope is held open is desirable to prevent unneeded contraction of the sides of the envelope that can result in misfeeds of insert material, while still holding the envelope opened wide enough to permit the filling of the envelope. Such an improvement could increase efficiencies in insertion of insert material into envelopes.

In light of the above, needs exist for improved handling of sheet articles within sheet processing systems, such as mail processing systems, particularly with regard to improving throughput and increasing efficiencies within a sheet processing machine.

SUMMARY

In accordance with this disclosure, novel apparatuses and methods are provided for improving handling of sheet articles during processing within sheet or mail processing machines, particularly for preparing and opening envelopes within an inserting system used to insert sheet material into envelopes. A variable envelope opener apparatus can be provided that selectively opens an envelope based on characteristics of the material to be inserted into an envelope.

Some of the objects having been stated hereinabove, and are achieved in whole or in part by the present subject matter. Other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill of the art is set forth more particularly in the remainder of the specification, including reference to the accompanying figures, in which.

DETAILED DESCRIPTION

Reference will now be made in detail to presently preferred embodiments of the present subject matter, one or more examples of which are shown in the various figures. Each example is provided to explain the subject matter and not as a limitation. In fact, features illustrated or described as part of one embodiment can be used in another embodiment to yield still yet another embodiment. It is intended that the present subject matter covers such modifications and variations.

The term "sheet article" is used herein to designate any sheet article, and can include, for example and without limitation, envelopes, sheet inserts folded or unfolded for insertion into an envelope or folder, and any other sheet materials.

The term "mail article" is used herein to designate any article for possible insert into a mailing package, and can include, for example and without limitation, computer disks, compact disks, promotional items, or the like, as well any sheet articles.

The term "document set" is used herein to designate one or more sheet articles and/or mail articles grouped together for processing.

As defined herein, the term "insert material" can be any material to be inserted into an envelope, and can include, for example and without limitation, one or more document sets, sheet articles, mail articles or combinations thereof.

Figure 1:
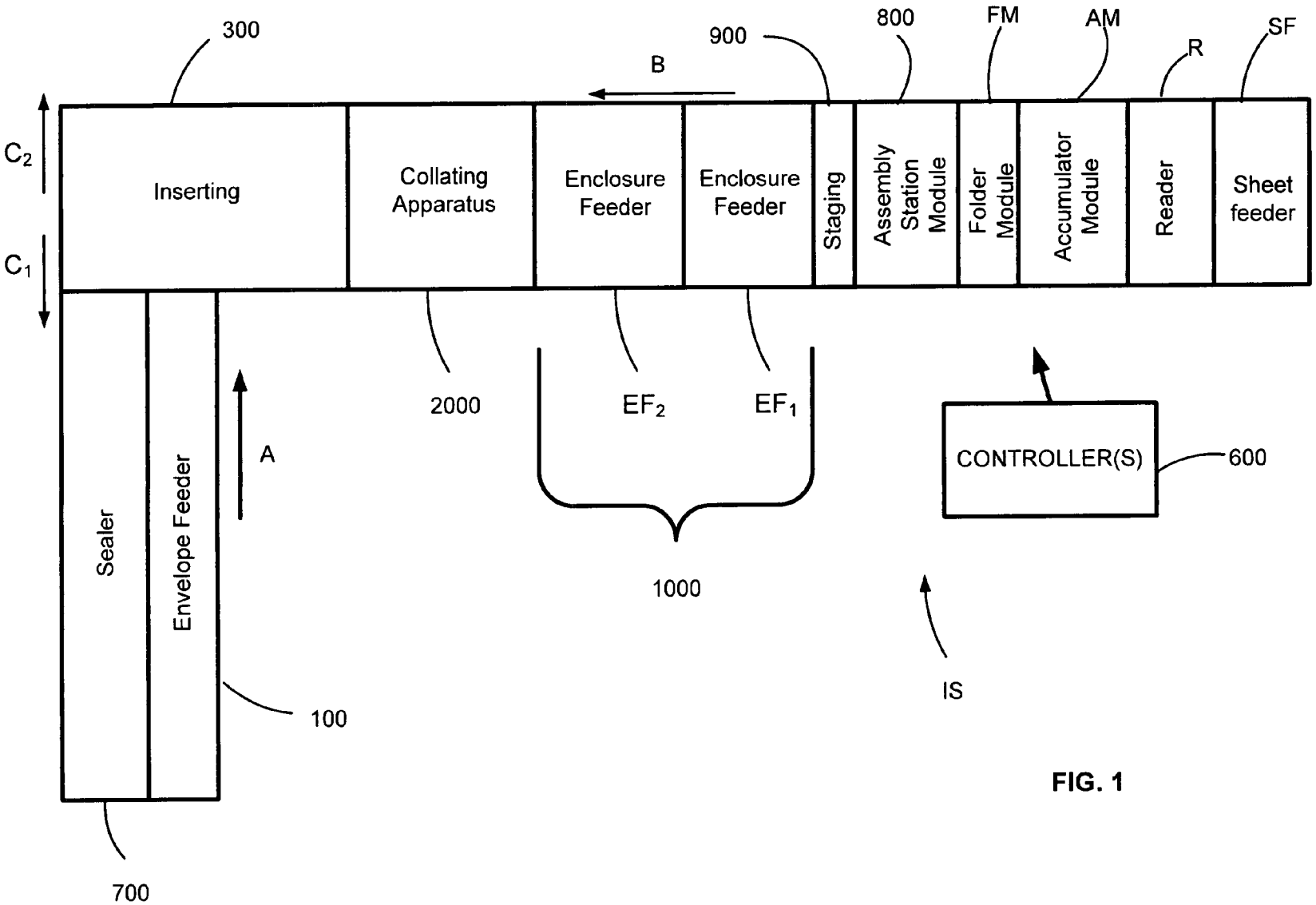
FIG. 1 illustrates a schematic view of an embodiment of an inserting system that can employ an embodiment of the present subject matter.

The present subject matter relates to sheet processing, such as, for example, mail inserting systems, mail sorting systems, and any other sheet processing systems. For example, FIG. 1 illustrates a plan schematic view of an inserting system, generally designated IS. The inserting system IS can comprise different modules that can be assembled in different arrangements for inserting material into envelopes. The different modules and inserting system IS can be controlled by a controller 600. The controller 600 can be computer hardware or software. For example, the controller can include one or more computers, mini-computers, programmable logic controllers or the like.

Inserting system IS can include, for example, an envelope feeder module, generally designated as 100, which feeds envelopes in a direction A into an inserting station module, generally designated as 300. An assembly station module 800 can be used to collect one or more sheet articles and/or one or more mail articles from upstream into a first document set that can be sent to a staging station 900 before being conveyed in a direction B toward inserting station module 300. In front of or behind each first document set on a conveying path of the inserting system IS, one or more sheet articles and/or mail articles can be fed on the conveying path to form second document sets as the first document sets move in the direction B so that each first document set and corresponding second document sets can be combined together into insert material for insertion into an envelope.

The second document sets are fed into the conveying path to be combined with the first document sets by one or more modules 1000 of enclosure feeders $EF_1$, $EF_2$. Each enclosure feeder module $EF_1$, $EF_2$ can include one or more station feeders for providing second document sets to be included in insert material to fill the envelope. Enclosure feeders $EF_1$, $EF_2$ can feed second document sets in front of the first document set or behind the first document set. Further, enclosure feeders $EF_1$, $EF_2$ can feed sheet articles and/or mail articles on top of the first document set.

In the examples shown, a collating apparatus module 2000, as shown and described in U.S. patent application Ser. No. 11/240,604, filed Sep. 30, 2005, the disclosure of which is incorporated herein by reference in its entirety, can be provided to collate the first and second document sets together before being feed to the inserting module 300 where the material can then be placed into an envelope. Each filled envelope can then be directed in direction $C_1$ into a sealer module 700 after insertion has occurred. The envelopes can be sealed in the sealer module 700 before they are sent out for metering and mailing. Further, the inserting module can include an apparatus for diverting defects in a direction $C_2$ out of the inserting system IS.

Other modules can be included in the inserting system IS. For example, a sheet feeder SF for feeding in sheet articles to be collected in the assembly station 800 is normally positioned upstream of the assembly station 800. Assembly station 800 can be followed by staging station 900. Further, other modules can be placed inside the inserting system IS such as a folder module FM, accumulator module AM and reader module R as are commonly used within the art. These modules can be placed anywhere within inserting system IS where they may be needed for a desired use.

Reader module R can be used to read and collect information from sheets passing under it, for example, from bar codes. Reader module R can be in direct communication with controller 600. Reader module R can read information from sheet articles and/or mail articles to be used by controller 600 to control inserting system IS. The information read by reader module R can help determine how a grouping of sheet articles and/or mail articles in a document set will be processed within inserting system IS. Further, the information can be used to determine what other document sets may be needed in the insert material for any particular envelope. Accordingly, the information can also be used to determine the amount of insert material to be received in each envelope.

According to certain aspects of the present subject matter, a variable envelope opener apparatus is provided for adjusting an opening of a mouth of an envelope for insertion of insert material into the envelope. The envelope opener apparatus can include a deck having a top side, a first end and a second end. The top side of the deck is configured to provide a conveying path for insert material. Also, the deck is pivotally movable between a first location and a second location. A holding system can be positioned downstream from the deck. The holding system can be configured to hold an envelope in an insertion position for receiving insert material. A feeding guide may be positioned proximal to the second side of the deck. The feeding guide is configured to be movable between a retracted position and an engaged position. In the engaged position, the feeding guide can hold open a mouth of an envelope when the envelope is in the insertion position.

According to other certain aspects of the present subject matter, a method for adjusting an opening of an envelope within an inserting system is provided. The method may include advancing insert material toward an envelope for insertion of the insert material into the envelope. A mouth of the envelope may be opened to an open position dependent upon of the physical characteristics of the insert material to be inserted into the envelope.

Figure 2:
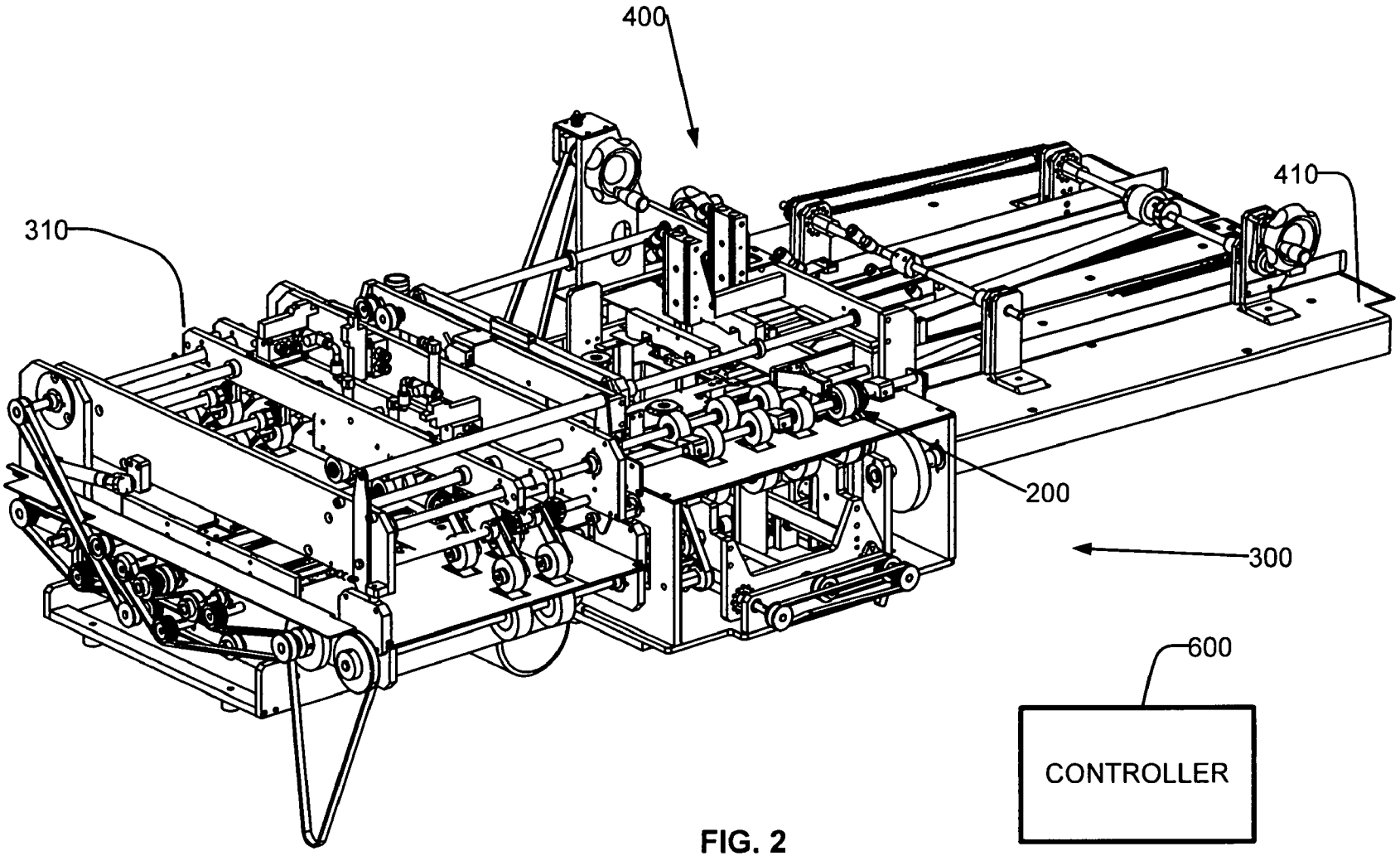
FIG. 2 illustrates a perspective view of an embodiment of an inserting station that can employ an embodiment of the present subject matter.

Inserting station module 300 is shown in more detail in FIG. 2. Inserting station 300 can include a variable envelope opener apparatus, generally designated as 400, for opening the envelope for receipt of the insert material therein. Variable envelope opener apparatus 400 can operate to permit an envelope to be opened in different widths depending on the characteristics of the insert material to be inserted into the envelope. As envelopes are fed into variable envelope opener apparatus 400, the envelopes can pass through a crease roller apparatus, generally designated as 200, to help ensure the flap of the envelope entering the variable envelope opener apparatus 400 does not interfere with the insertion of the insert material into the envelope. When an envelope is in the variable envelope opener apparatus 400, insert material can travel on the conveying path including atop deck 410, which helps to direct the insert material into an envelope within the variable envelope opener apparatus 400. Once the insert material has been inserted into the envelope, the envelope is conveyed down inserting station 300 to a right-angle-turn apparatus, generally designated as 310, where the filled envelope can then be conveyed into sealer module 700 as described above or can be diverted out of the inserting system IS in direction $C_2$ as shown in FIG. 1 if a defect or problem is detected with the envelope.

Figure 3:
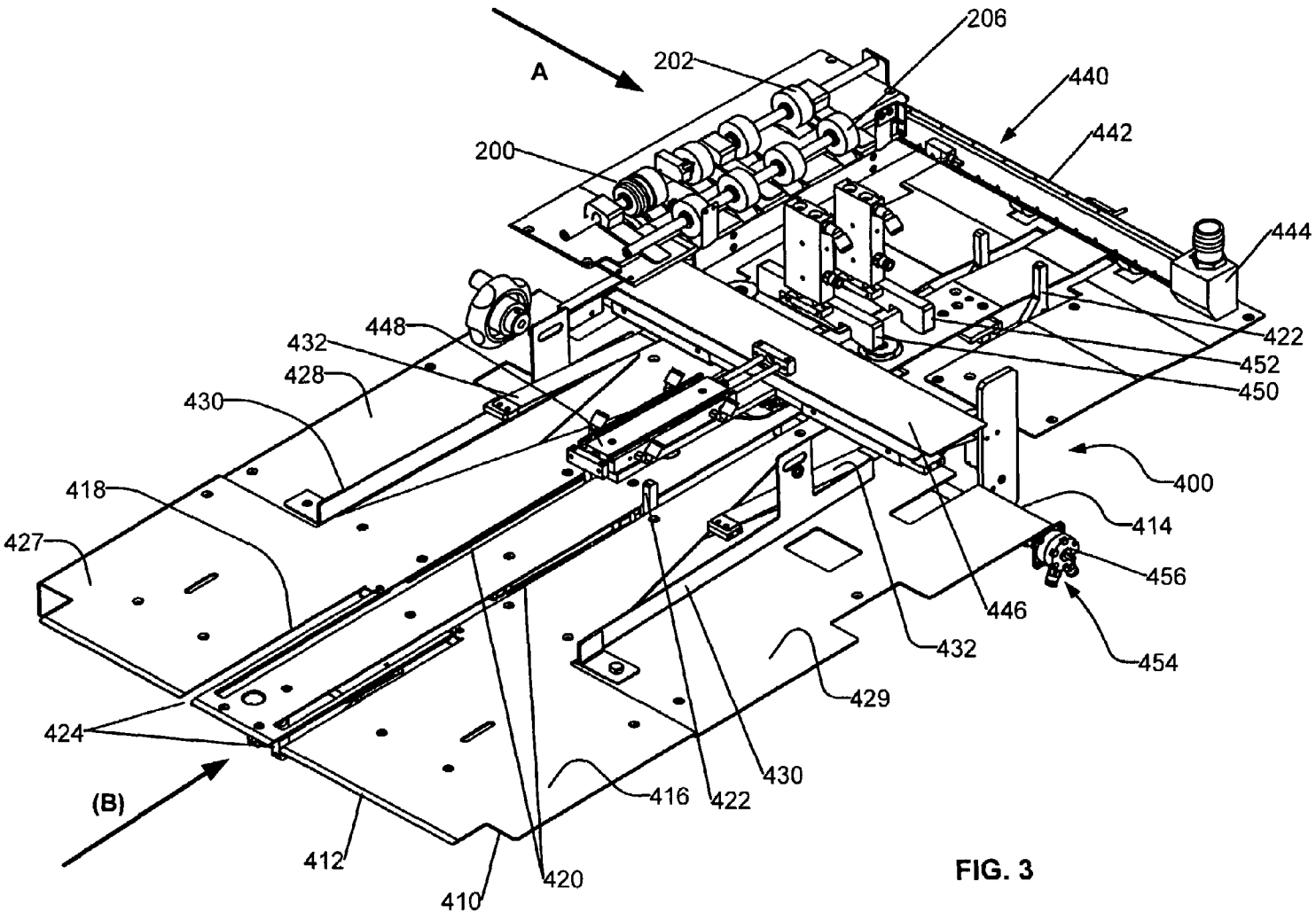
FIG. 3 illustrates a perspective view of embodiments of a variable envelope opener apparatus, a registration apparatus, and a crease roller apparatus according to the present subject matter.

FIG. 3 illustrates a perspective view of variable envelope opener apparatus 400 and crease roller apparatus 200. The variable envelope opener apparatus 400 includes deck 410 having a first end 412 and a second end 414. Deck 410 further includes a top side 416 that is configured to provide a conveying path 418 for insert material to be conveyed long toward an envelope in which it shall be inserted. Deck 410 can include one or more elongated slots 420 for pusher members 422.

As shown in the illustrated embodiment, a pair of elongated slots 420 can be aligned down the conveying path 418 or deck 410. In such an embodiment, a pair of insertion pusher members 422, such as pusher pins or picks, can be conveyed down the parallel slots 420 such that the insertion pusher members 422 are conveyed parallel to one another to register the insert material and push the insert material into an envelope. Insertion pusher members 422 can then convey the envelope onto the right-angle-turn apparatus 310 to be conveyed to sealing module 700 or be diverted out of the inserting system if there is a defect therein. The deck 410 can also include elongated slots 424 in which collecting pusher members (not shown) from downstream in the inserting system IS can be conveyed. In such an embodiment, collecting pusher members can convey the insert material along conveying path 418 in direction B from upstream until such point that insertion pusher members 422 pick up the insert material to be conveyed toward the envelope. At such point, the collecting pusher members descend below conveying path 418 and deck 410.

The deck 410 can include a first platform 427 which overlays a second platform 428 and a third platform 429 to form the top surface 416 of the deck 410. Top side 416 can have insert guides 430 on either side of the conveying path 418 to help guide the insert material toward the envelope. Insert guides 430 can be adjustable to accommodate different sized insert material thereby helping to funnel the insert material toward the envelope. Flexible tabs 432 can be positioned above top side 416 of deck 410 such that the insert material can pass between the tabs 432 and top side 416 for the deck 410. Tabs 432 can be attached to the insert guide such that tabs 432 moves with insert guides 430. Tabs 432 can extend under the flap of the envelope but not into the mouth of the envelope in which the insert material is to be received.

Envelopes fed in direction A can be fed under crease roller apparatus 200 by sets of feed rollers 202, 206. The crease roller apparatus can score envelopes entering the variable envelope opener apparatus 400 along the fold of flaps of the envelope to bend the flaps of the envelopes against the fold. This scoring helps to keep the envelopes open for insertion of material as described in more detail below.

The sets of feed rollers 202, 206 feed the envelopes into a registration apparatus, generally designated as 440, that includes a housing 442 and a vacuum connection 444. Registration apparatus 440 registers the envelopes fed therein by the feed rollers to align the envelopes. The registration apparatus 440 and a flat plate 446 hold the envelopes fed into the registration apparatus 444 in a staging position. Flat plate 446 can be moved back and forth by an actuator 448 between an extended position and a retracted position. When flat plate 446 is extended, flat plate 446 is in a holding location. When flat plate 446 is retracted, flat plate 446 is in an entry location. A first drop bar 450 is positioned above flat plate 446 and a second drop bar 452 is placed above the staging position between flat plate 446 and registration apparatus 440. As flat plate 446 is moved from the holding location to the entry location, first drop bar 450 and second drop bar 452 push each envelope into an insertion position where a holding system holds that envelope. A feeding guide, generally designated as 454, which can include a rotary actuator 456 can rotate fingers into the mouth of each envelope in the insertion position to hold it open while insertion pusher members 422 push the insert material into the envelope and then carry the envelope to right-angle-turn apparatus 310 shown in FIG. 2. Depending on the physical characteristics of material to be inserted into the envelopes, envelopes can be held open in various degrees by shifting deck 410 and feeding guide 454 between different locations. Such shifting of deck 410 and feeding guide 454 and the variable envelope opener apparatus 400 will be described in more detail below.

Figure 4A:
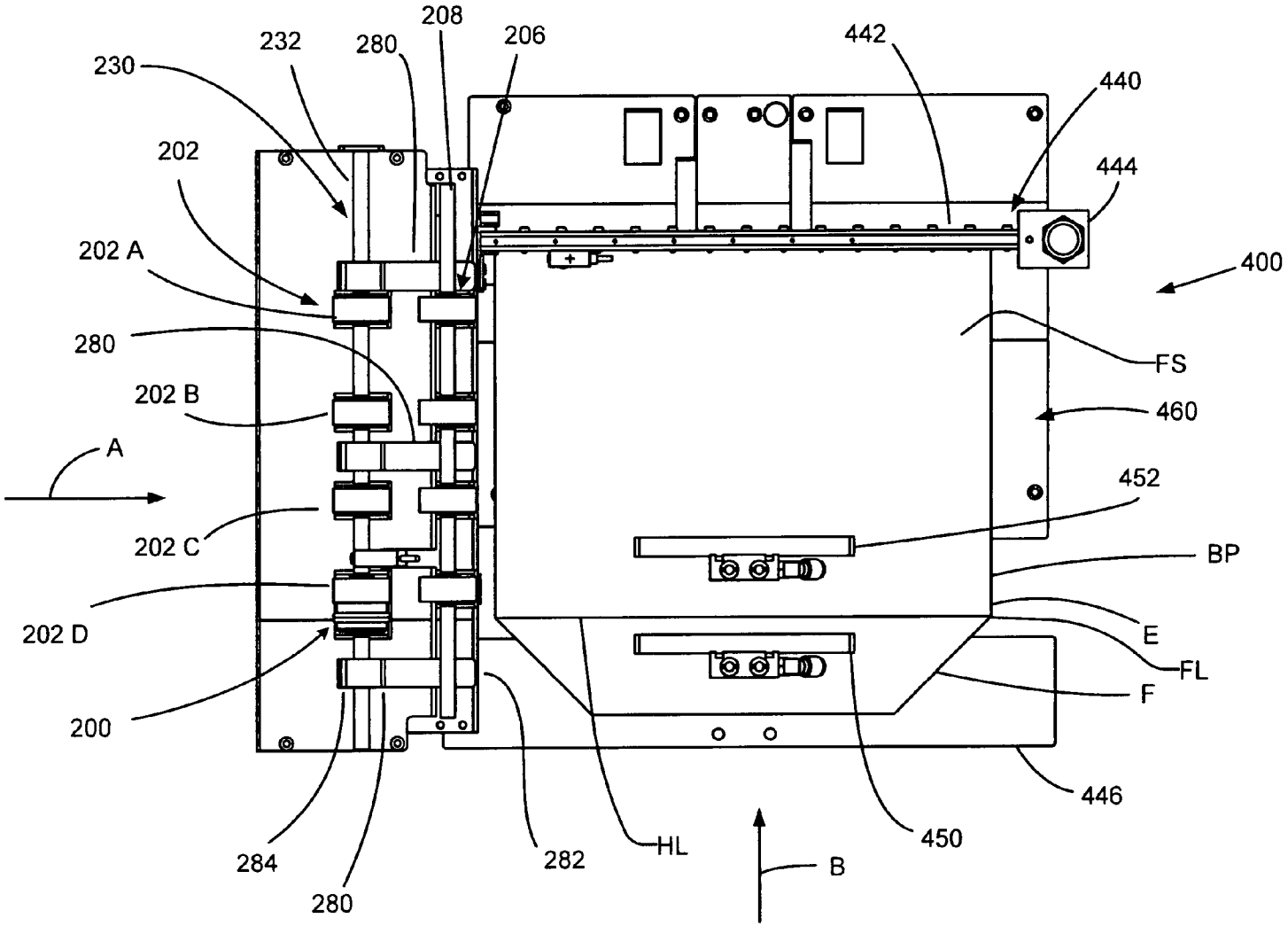
FIG. 4A illustrates a top plan view of the envelope residing in the registration apparatus according to FIG. 3.

FIG. 4A illustrates an envelope E that has been fed into a staging position, generally designated as 460, within variable envelope apparatus 400. Envelope E has a body portion BP and a flap F. A fold FL is created between body portion BP and flap F along a crease or hinge line HL. Body portion B can have a face side FS on which an address window usually resides or an address is usually printed. Body portion BP also has a backside. The backside of the body portion BP is where flap F can be secured to body portion BP to close envelope E. Those skilled in the art will recognize that although the registration apparatus 440 is generally described relative to the processing of an envelope in the foregoing paragraphs, folded sheet articles or the like will operate in a similar manner.

Envelope E can be fed from the envelope feeder apparatus 100 (see FIG. 1) such that envelope E has face side FS of body portion BP of envelope E facing upward. Flap F of envelope E extends outward from hinge line HL away from body portion BP of envelope E. The first set of feed rollers 202 transports envelope E and, along with the second set of feed rollers 206, feed envelope E into the registration apparatus 440 such that flap F resides on flap plate 446. A negative pressure can be created through housing 442 of registration apparatus 440 by vacuum connection 444 to register envelope E within registration apparatus 440. As shown in FIG. 4, envelope E is, at this point, aligned under first drop bar 450 and second drop bar 452. First drop bar 450 and second drop bar 452 can be used to help push envelope E from staging position 460 into an insertion position. While envelope E is being fed by the sets of feed rollers 202, 206 into registration apparatus 440, crease roller apparatus 200 can score envelope E along the hinge line HL to bend flap F of envelope E in an inverted direction from that of the original fold along hinge line HL.

Figure 4B:
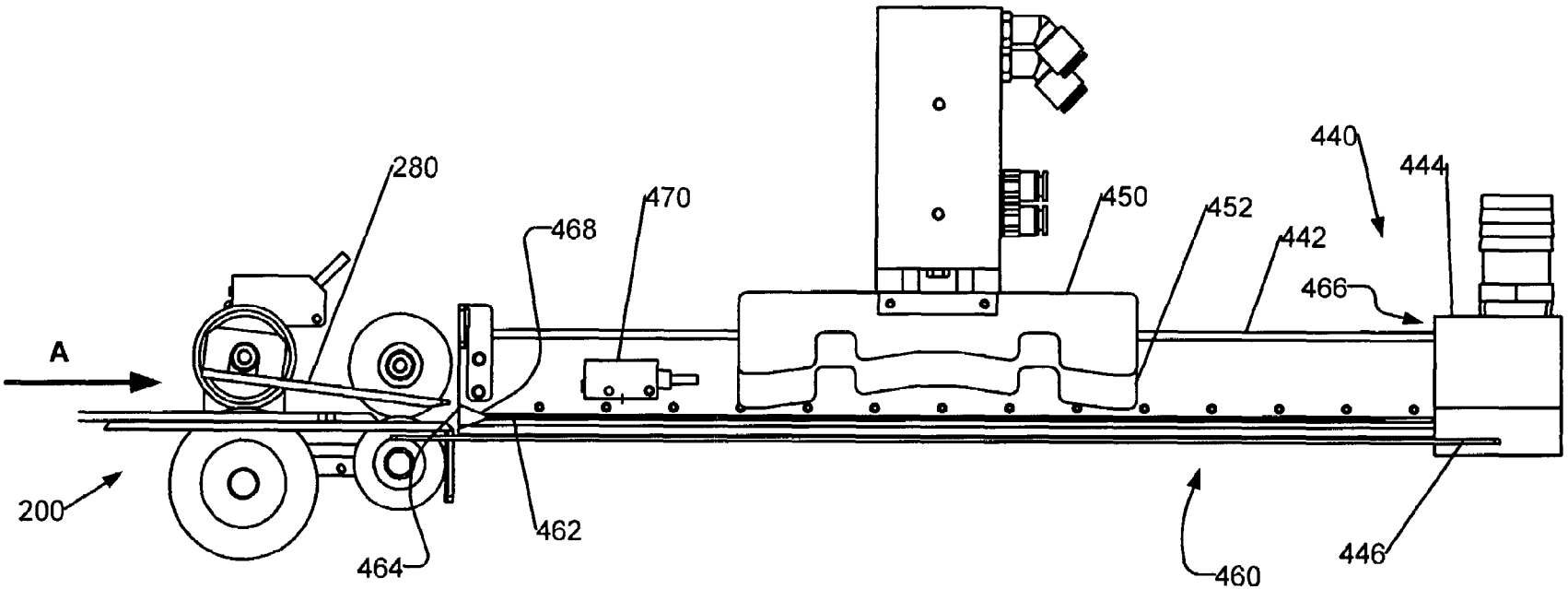
FIG. 4B illustrates a side view of a portion of the variable envelope opener apparatus of FIG. 3.

After the envelope has been scored by crease roll apparatus 200, the envelope can be fed into registration apparatus 440 for registering within variable envelope opener apparatus 400. As shown in FIGS. 4A and 4B, crease roll apparatus 200 and the set of feed rollers 202, 206 are aligned to feed the envelope along direction A so that the rear end of the envelope resides in registration apparatus 440 and the flap end of the envelope resides on flap plate 446, thereby holding the envelope in a staging position 460. As mentioned above, registration apparatus 440 can include housing 442 and vacuum connection 444. Housing 442 defines a slit 462 along at least a portion of the length of housing 442 for receiving a portion of an envelope being fed into housing 442. Slit 462 can be in a straight line within housing 442. Further, slit 462 can have a convex or a concave shape. Housing 442 can have a first end 464 and a second end, generally designated as 466. Vacuum connection 444 can be attached to housing 442 at second end 466 of housing 442. First end 464 of housing 442 can define an entrance 468 for slit 462 for receiving an envelope fed by the set of feed rollers 206. Vacuum connection 444 can provide a negative pressure within housing 442 from a vacuum source that aligns the envelope within the slit 462. A sensor 470 can detect the presence of an envelope within staging position 460 when the envelope resides in registration apparatus 440 and on top of flap plate 446. Once the envelope is received within staging position 460, first drop bar 450 and second drop bar 452 can be readied to push the envelope out of staging position 460 and into the insertion position within the variable envelope opener apparatus 400.

Figure 5A:
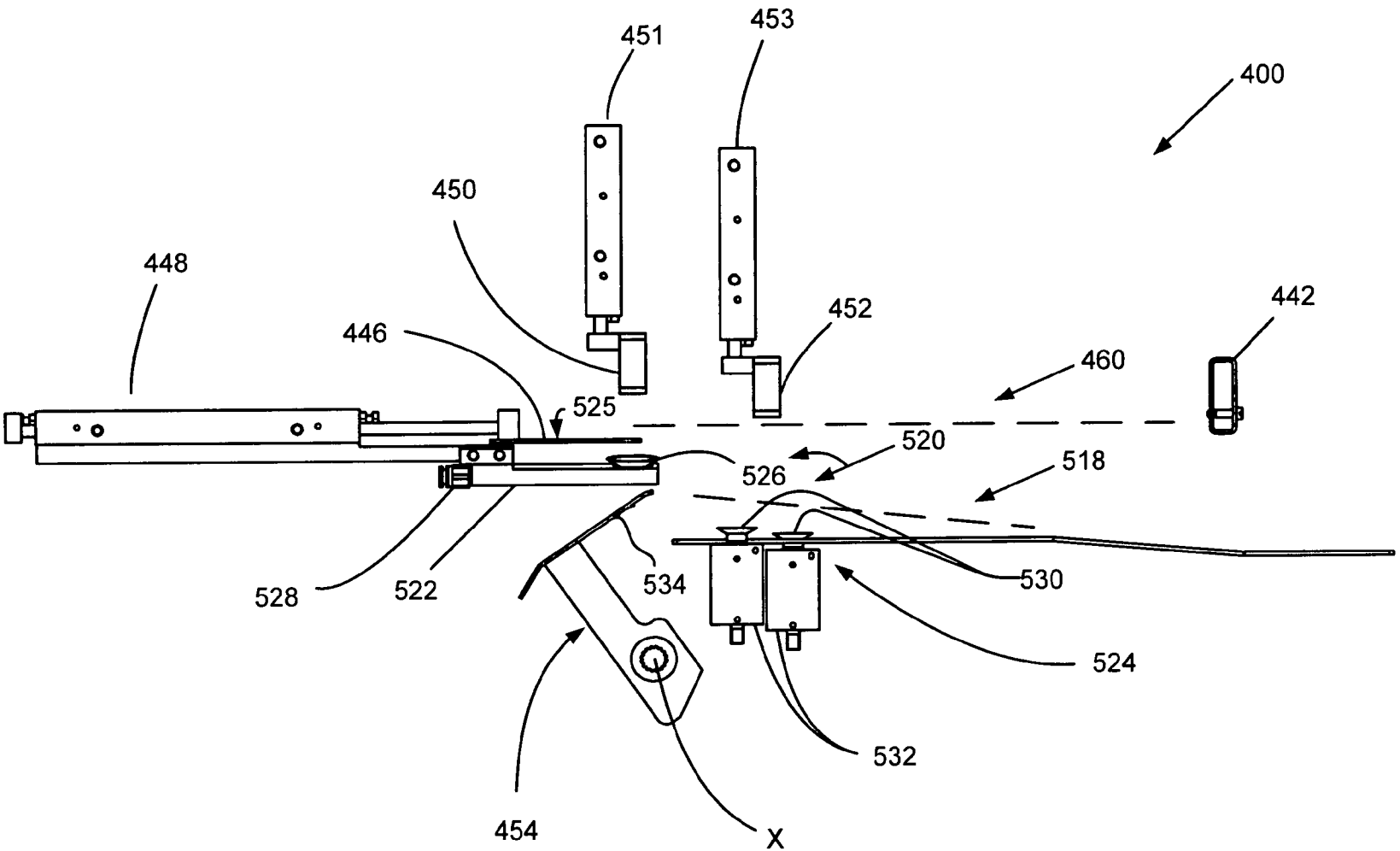
FIGS. 5A, 5B and 5C illustrate schematic side views of portions of the variable envelope opener apparatus according to FIG. 3.
Figure 5B:
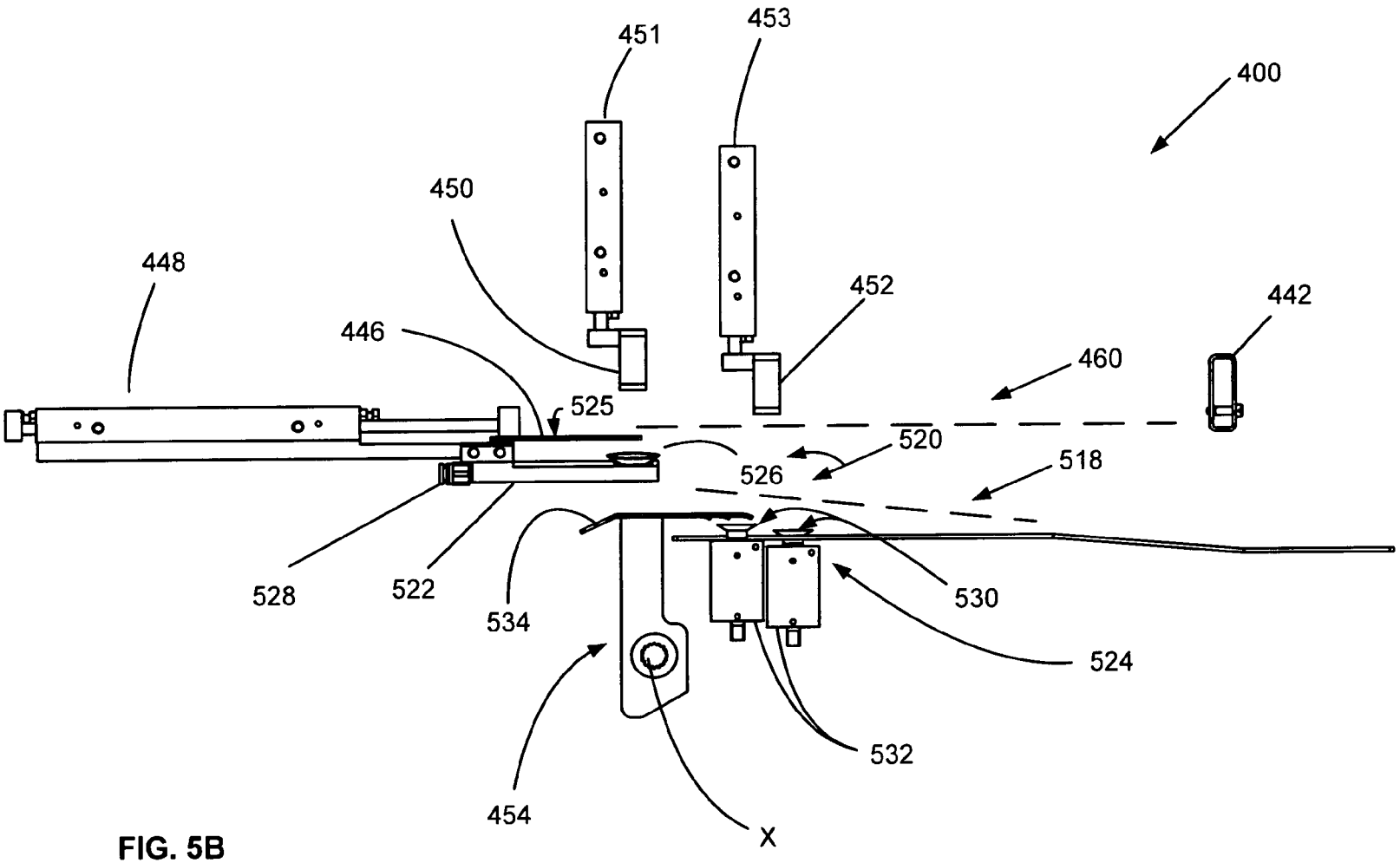

FIGS. 5A and 5B illustrate schematics of a partial cross-sectional view of a portion of variable envelope opener apparatus 400. Staging position 460 as stated above can be created by holding envelopes between housing 442 of registration apparatus 440 (see FIGS. 4A and 4B) and flap plate 446. Envelopes can then be pushed by first and second drop bars 450, 452 into an insertion position, generally designated as 518, were a holding system generally designated as 520, facilitate the securing of the envelopes in insertion position 518 for receipt of insert material. Holding system 520 can include a first holding device 522 for holding the flaps of the envelopes. Further, a second holding device 524 can be used in the holding system 520 to temporarily hold the body portion on the backside of the envelopes to facilitate insertion of feeding guide 454 into the mouth of the envelope as will be explained in more detail below.

As shown in FIG. 5A, flap plate 446 can be held in a holding location 525 where flap plate 446 resides directly above first holding device 522 of holding system 520. When flap plate 446 is in holding location 525, staging position 460 is created for an envelope registered within housing 442 of registration apparatus 440 (see FIGS. 4A). Beneath staging position 460, insertion position 518 is located for holding an envelope open for receiving insert material therein within the inserting station. Once the envelopes enter insertion position 518, first holding device 520 can be used to hold the flap of the envelope during the insertion process of the insert materials into the envelope. First holding device 522 can include one or more suction cups 526 in communication with a vacuum connection 528 to provide a negative pressure, or suction, through suction cups 526. Vacuum connection 528 can selectively provide the negative pressure to suction cups 526 to hold the flap of an envelope being processed each time when flap plate 446 is moved from holding location 525 to an entry location (not shown) and first drop bar 450 contacts the flap of the envelope to push it in contact with suction cups 526 through the action of the actuator 451 of first drop bar 450. First holding device 520 can hold the envelope until the material is inserted into the envelope and the envelope is to be taken downstream for further processing.

Figure 5C:
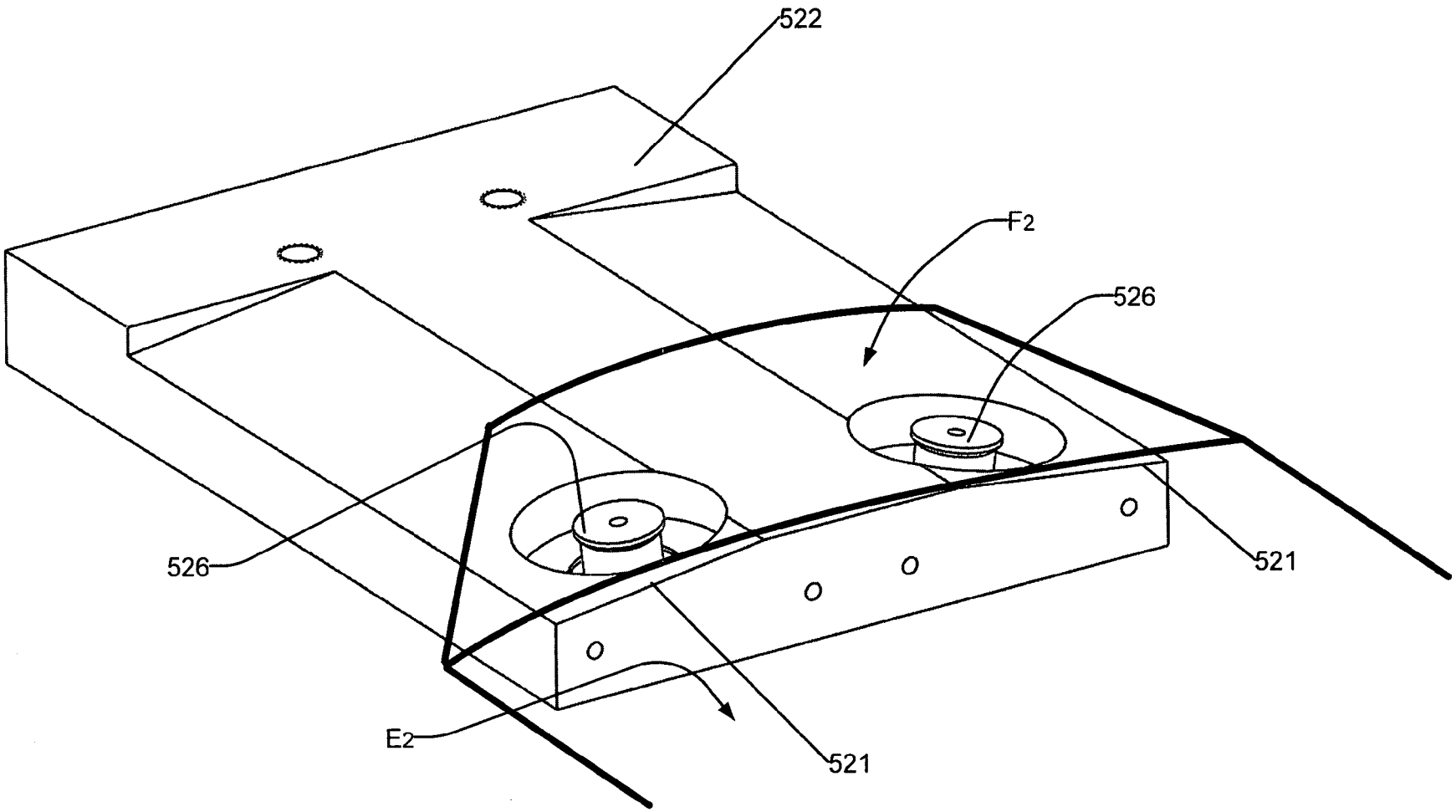

First holding device 522 is shown in an isometric view in FIG. 5C. Suction cups 526 are mounted on the first holding device in a formation that can impart a curve to envelope flap $F_2$ when first drop bar 450 (FIG. 10) pushes the envelope flap onto suction cups 526. By holding the envelope flap in a curved position created by the angled geometry 521 of first holding device 522, the sides of the envelope are free to move in as the envelope is opened without risk of damaging the envelope flap. As used herein, angled geometry is defined as any curved or angled surface or combination thereof that can be used for holding an envelope flap in a curved position. The risk of damage is further reduced by having suction cups 526 close together and near the center of the envelope flap. If the envelope flap is held flat and is secured near the edges, the envelope flap is prone to tearing as the envelope is opened to accommodate a large insert. Envelope $E_2$ and envelope flap $F_2$ are not show to scale in FIG. 5C.

Second holding device 524 can include one or more suction cups 530 used to hold down the body portion of the envelope on the back side such that first holding device 522 and second holding device 524 hold the mouth of the envelope open in a wide stance. The one or more suction cups 530 can be secured to one or more vacuum connections 532 to selectively provide vacuum suction to the body portion of the envelope for a set period. Feeding guide 454, partially shown in FIGS. 5A and 5B, can include fingers 534 which can be inserted into the mouth of an envelope held open by first holding device 522 and second holding device 524. As discussed in more detail below, feeding guide 454 can be moved from a retracted position to an engaged position. This movement of feeding guide 454 can be rotational or linear movement. As shown in FIGS. 5A and 5B, feeding guide 454 can rotate about axis X to move between the engaged position and the retracted position. As shown in FIG. 5A, feeding guide 454 is positioned in a retracted position. As shown in FIG. 5B, feeding guide 454 with its fingers 534 is positioned in the engaged position. At such point and time when feeding guide 454 assumes the engaged position and the fingers 534 are within an envelope mouth, suction cups 530 can release the body portion of the envelope such that the first holding device 520 and the feeding guide 454 hold the envelope open for insertion of insert material.

Figure 6:
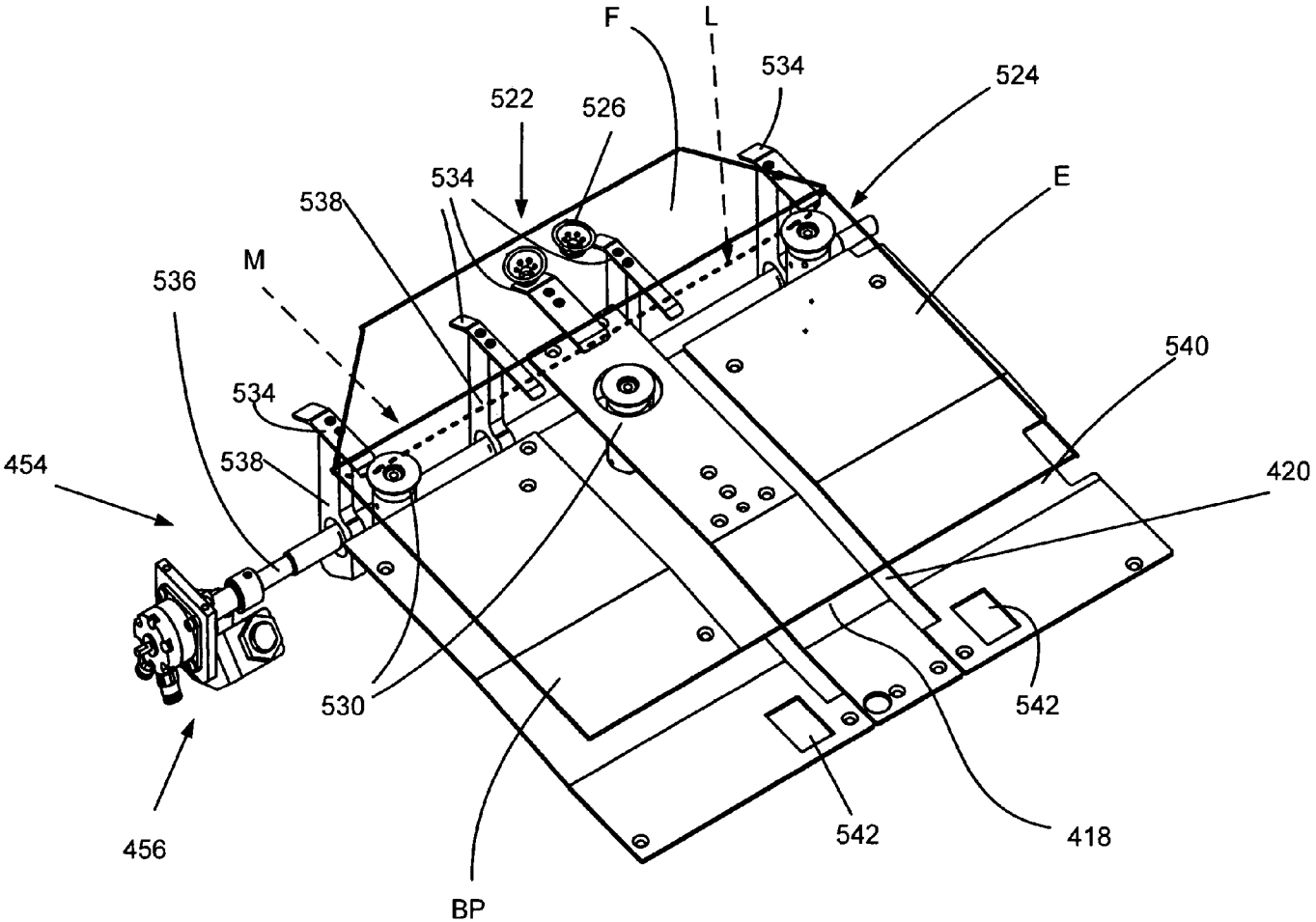
FIG. 6 illustrates a perspective view of a portion of the variable envelope opener apparatus according to FIG. 3.

As can be seen in FIG. 6, the suction cups of 526 of the first holding device 522 and the suction cups 530 of the second holding device 524 can hold an envelope E, shown in phantom, in conveying path 418. While first holding device 522 and second holding device 524 are holding envelope E, feeding guide 454 can insert fingers 534 into mouth M of envelope E. Feeding guide 454 can include a rotary actuator 456, secured to a positioning rod 536 on which extending arms 538 that support fingers 534 can be attached. Rotary actuator 456 can rotate positioning bar 536 to move extending arms 538 and fingers 534 from a retracted position to an engaged position. Once fingers 534 are inserted into mouth M of envelope E, suction cups 530 of second holding device 524 can release body portion BP of envelope E so that lip L of envelope E resides against and beneath fingers 534. At this point, insert material can be pushed along conveying path 418 by the insertion pusher members over fingers 534 and into mouth M of envelope E. The insertion pusher members can travel down along the elongated slot 420 that extends from the deck 410 (see FIG. 3) into insertion deck 540. The insertion deck 540 can further define apertures 542 therein to allow transport rollers to catch the envelope and transport it further down stream into left-angle-turn apparatus 310 shown in FIG. 2.

Figure 7:
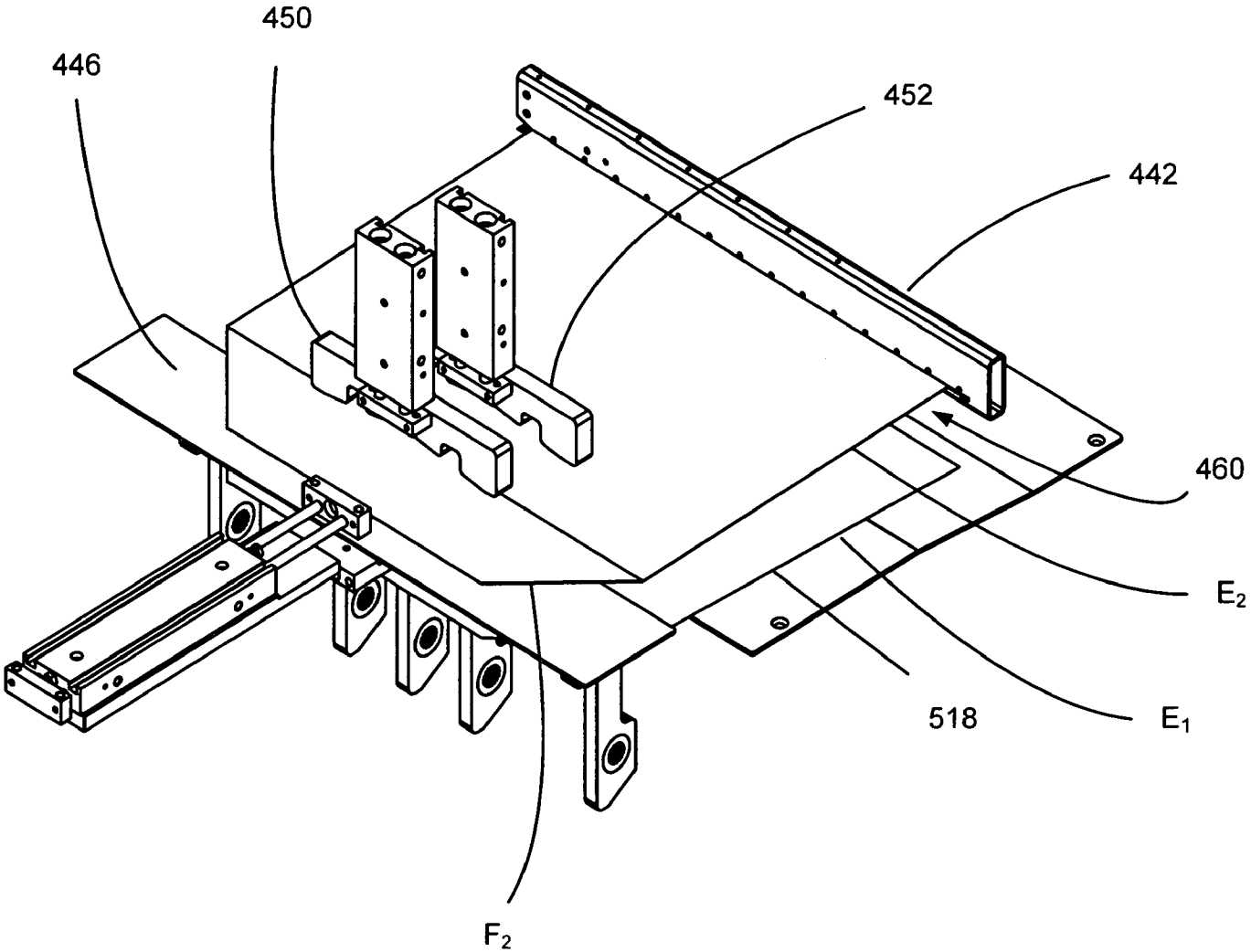
FIG. 7 illustrates a top plan view of the portion of the variable envelope opener apparatus according to FIG. 6.

During the time that the envelope is in the insertion position 518, another envelope can be fed into housing 442 of registration apparatus 440 (see FIGS. 4A) and into the staging position 460 above the envelope in the insertion position 518 as illustrated in FIG. 7. Once a first envelope $E_1$ enters insertion position 518, a second envelope $E_2$ can be fed into staging position 460 and registered within housing 442 of the registration apparatus while the envelope $E_1$ is being processed to receive insert material. In this manner, the next envelope to receive insert material is positioned and readied, thereby reducing the amount of time to prepare the envelope for receipt of insert material. While the first envelope $E_1$ is being processed, housing 442 and flat plate 446 hold second envelope $E_2$ registered and ready to be pushed by first drop bar 450 and second drop bar 452 into insertion position 518. Once first envelope $E_1$ has received insert material and is being moved downstream for further processing, second envelope $E_2$ can be pushed into insertion position 518.

Figure 8:
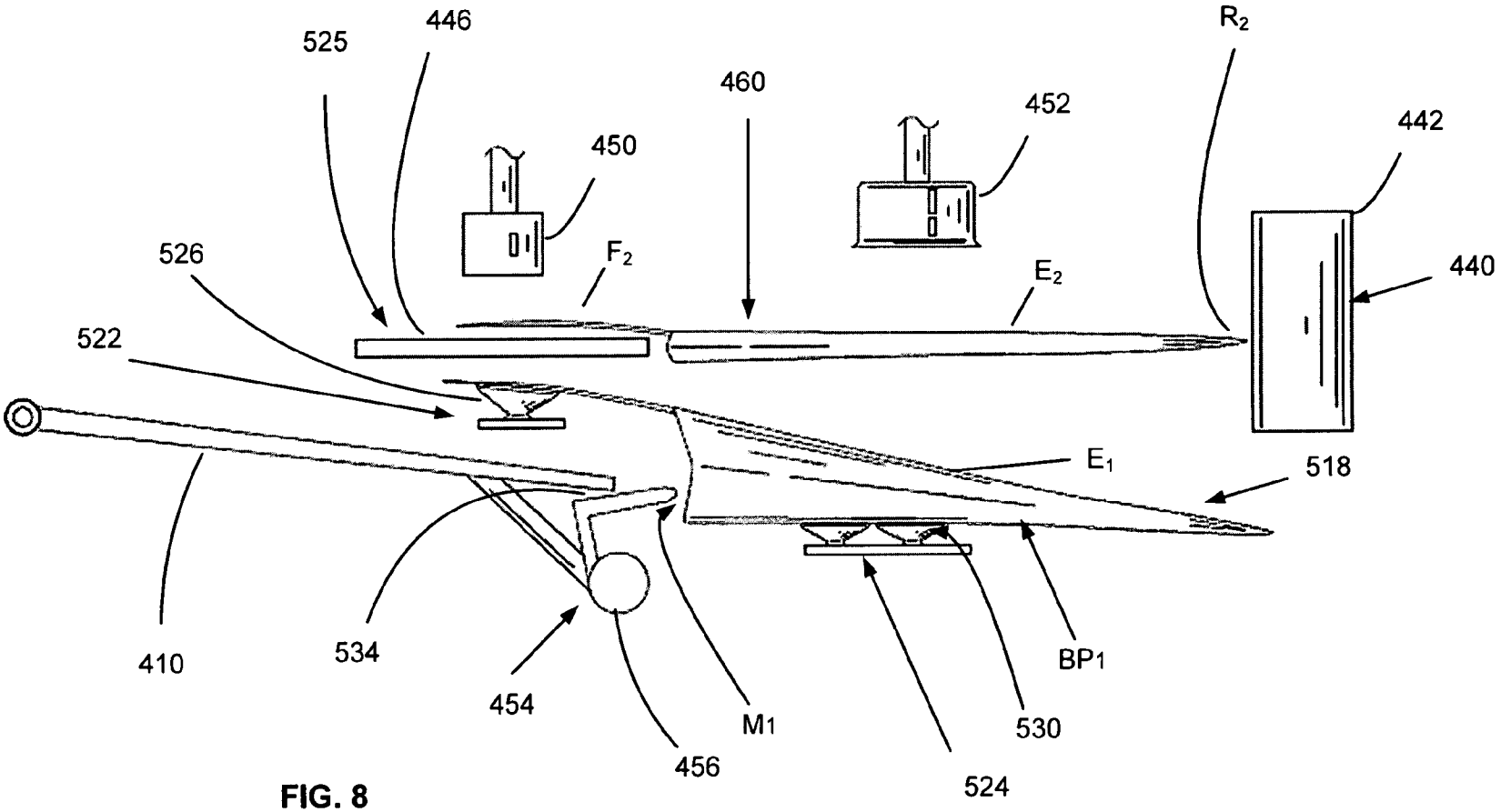
FIG. 8 illustrates a schematic side view of a variable envelope opener apparatus with envelopes being processed according to the present subject matter.
Figure 9:
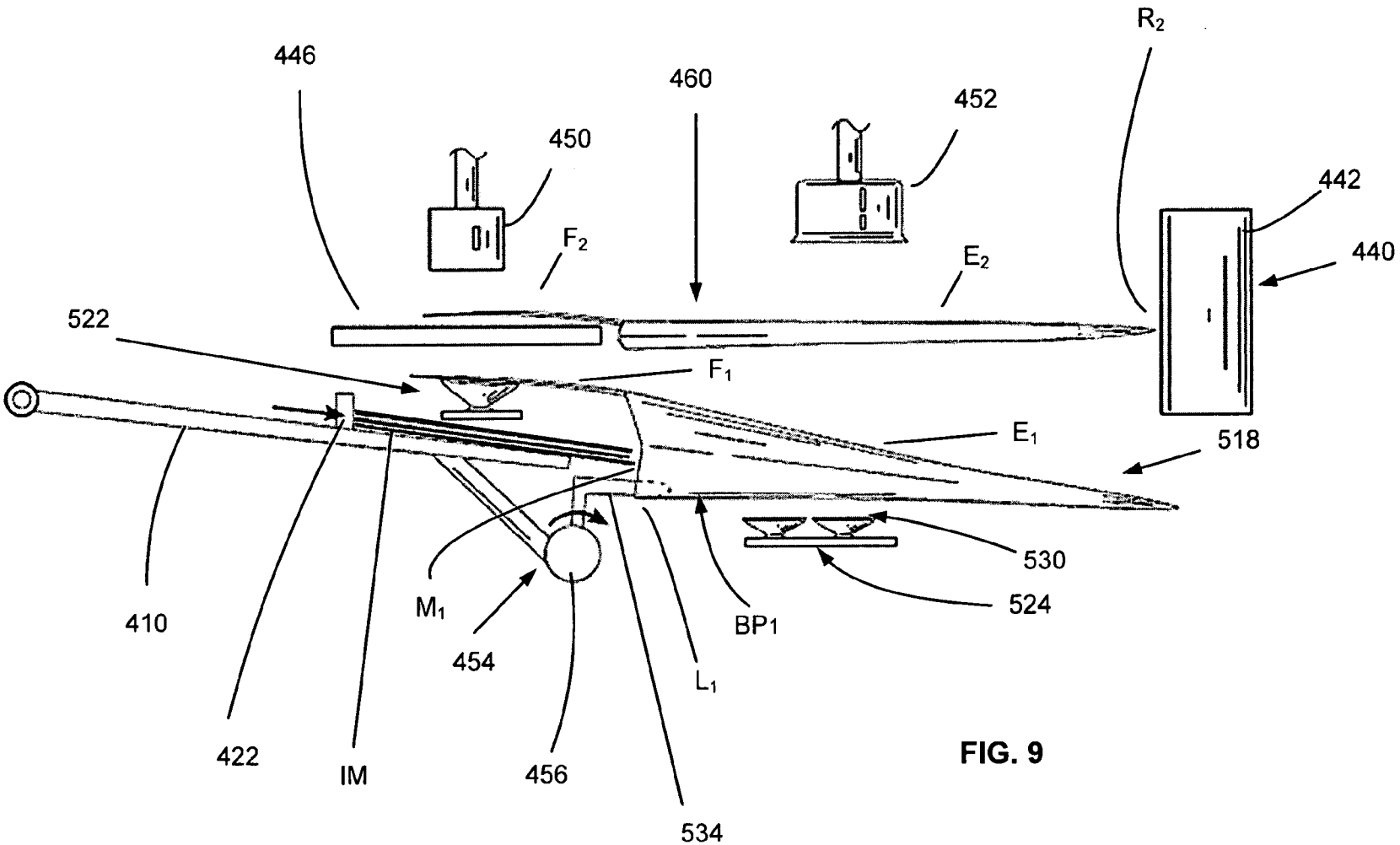
FIG. 9 illustrates a schematic side view of a variable envelope opener apparatus with envelopes being processed according to the present subject matter.
Figure 10:
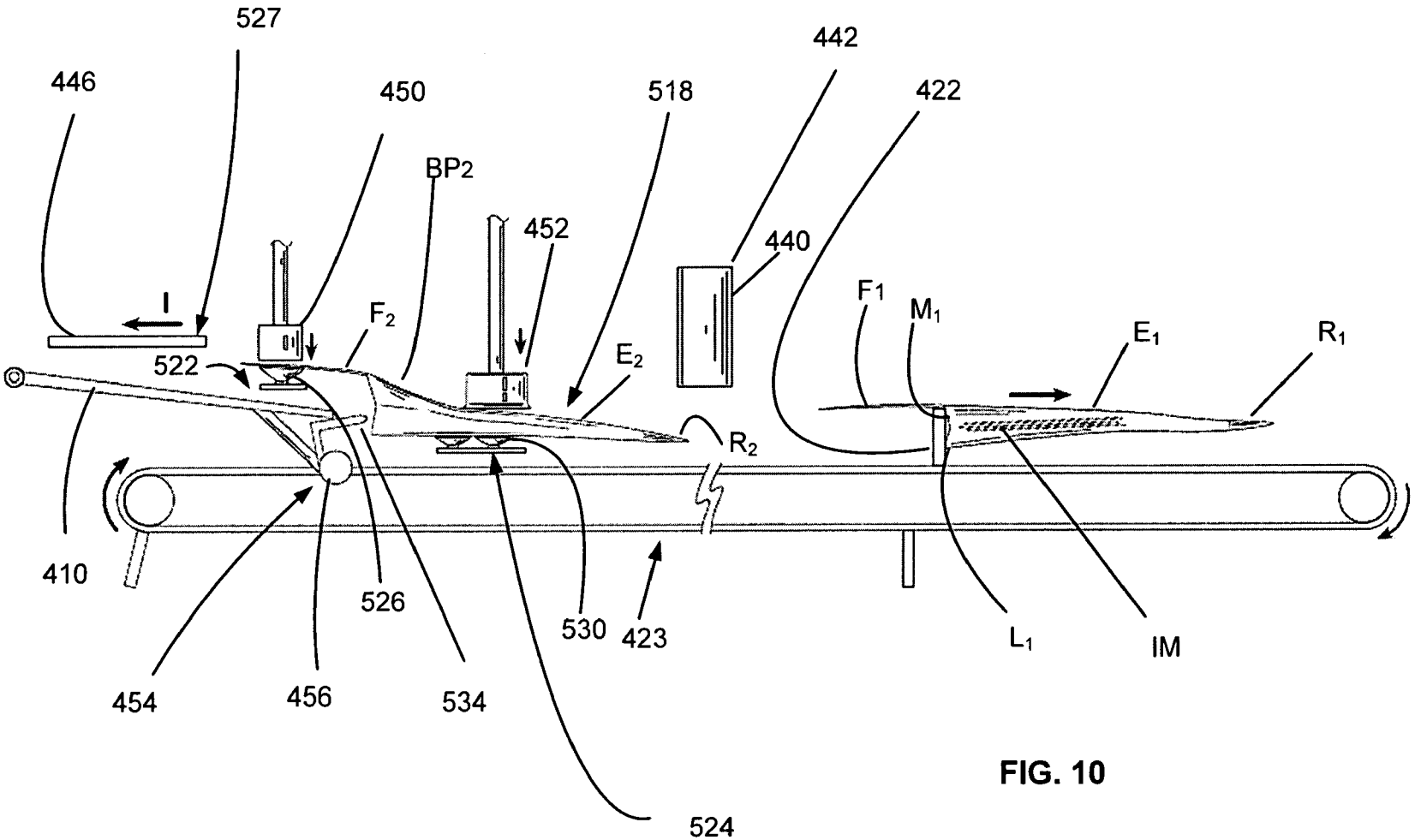
FIG. 10 illustrates a schematic side view of a variable envelope opener apparatus with envelopes being processed according to the present subject matter.

FIGS. 8-10 illustrate a schematic view of the processing of envelopes for insertion within variable envelope opener apparatus 400. Once envelope $E_1$ has entered insertion position 518, first holding device 522 holds flap $F_1$ with one or more suction cups 526 and second holding device 524 holds the back side of body portion $BP_1$ with suction cups 530 so that a mouth $M_1$ of envelope $E_1$ is held open in a wide stance for insertion of fingers 534 of a feeding guide 454. A second envelope $E_2$ is then fed into registration apparatus 440 such that a rear end $R_2$ resides in housing 442 of registration apparatus 440, while a flap $F_2$ of an envelope $E_2$ resides on a flat plate 446 in staging position 460.

As shown in FIG. 9, rotary actuator 456 of feeding guide 454 rotates fingers 534 into mouth $M_1$ of envelope $E_1$, and suction cups 530 of second holding device 524 release the back side of body portion $BP_1$ while first holding device 522 still retains flap $F_1$ of envelope $E_1$. Once fingers 534 are rotated into mouth $M_1$ of envelope $E_1$ and the second holding device releases body portion $BP_1$, lip $L_1$ resides underneath and against fingers 534 of feeding guide 454. In this manner, mouth $M_1$ of envelope $E_1$ is held open in a wide enough stance to allow insertion pusher members 422 to push insert material IM into the mouth $M_1$ of envelope $E_1$ as the insertion material travels over deck 410 and fingers 534 into envelope $E_1$.

The distance that first holding device 522 and fingers 534 hold mouth $M_1$ of envelope $E_1$ open allows insertion of the material and, at the same time, prevents a contraction of the sides of envelope $E_1$ that might interfere with such an insertion. This distance at which the mouths of envelopes can be held open can be changed by variable envelope opener apparatus by rotating deck 410 and feeding guide 454 to which it is attached between different locations. As will be described in greater detail below, depending on the characteristics of the insert material (e.g., the amount of material to be inserted, the corresponding collective thickness of the material to be inserted, etc.), deck 410 and feeding guide 454 can be moved between different locations, thereby changing the distance the mouth of the envelope is held open.

As shown in FIG. 10, insertion push members 422 can catch envelope $E_1$ at lip $L_1$ and underneath flap $F_1$ and push envelope $E_1$ to a point where rollers grab a rear end $R_1$ and transport envelope $E_1$ downstream for furthering processing. The pairs of insertion push members 422 are secured to a conveyor system, generally designated as 423, that rotates the pairs of insertion pusher members 423. The timing of the feeding of the envelopes and the speed of the different conveyor systems, like conveyor system 423, in inserting system IS can be coordinated by controller 600 (shown in FIG. 2). As the insertion pusher members 422 push insert material IM into envelope $E_1$ and catches lip $L_1$ of envelope $E_1$, first holding device 522 releases flap $F_1$. Rotary actuator 456 of feeding guide 454 rotates feeding guide 454 from the engaged position back to the retracted position before envelope $E_2$ is pushed from staging position 460 into insertion position 518. At this point, flap plate 446 can be moved from its holding location 525 as seen in FIG. 8 in a direction I out of a holding location into an entry location 527. First drop bar 450 and second drop bar 452 can then push second envelope $E_2$ out of staging position 460 and into insertion position 518. Flap $F_2$ can be pushed in contact with suction cups 526 of first holding device 522 by first drop bar 450. The back side of body portion $BP_2$ of second envelope $E_2$ can be pushed into contact with suction cups 530 of second holding device 524 by second drop bar 452. At this point, drop bars 450, 452 are raised and another envelope is fed into staging position 460, while envelope $E_2$ is prepared for receiving the insert material.

Figure 11:
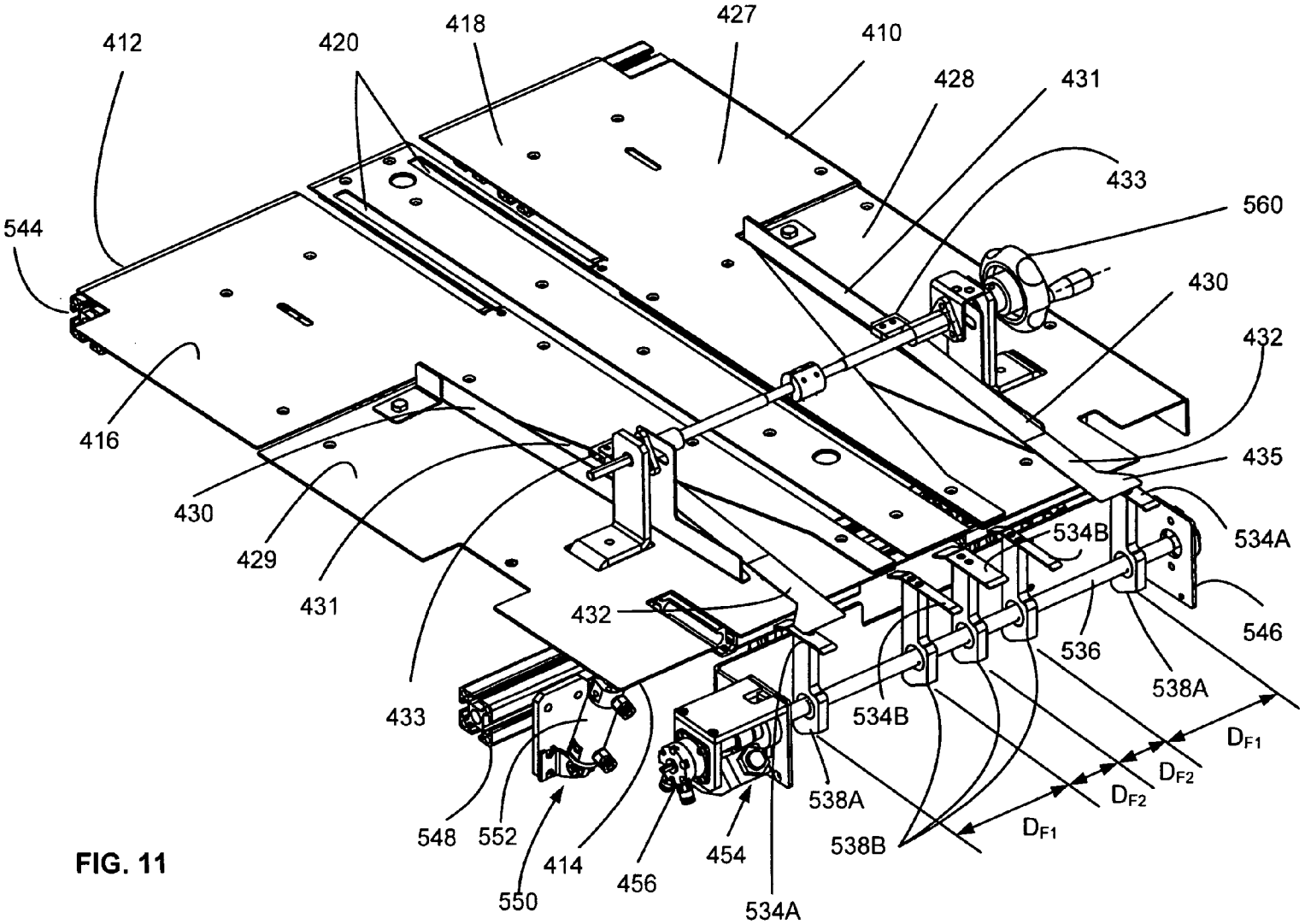
FIG. 11 illustrates a perspective view of an embodiment of a deck of the variable envelope opener apparatus according to FIG. 3.

As seen in FIG. 11, insert guides 430 as well as the positioning of fingers 534 in feeding guide 454 can be changed depending on the size of the inserts and envelopes being used. Insert guides 430 can be moved from an outer stance for larger or longer insert material to a narrower stance through the use of an adjuster device 560. Insert guides 430 can move in along platform 429 and platform 428, respectively, up to a position where they abut platform 427 of deck 410 to accommodate different size insert material to be used. At the same time, as the size of the insert material changes, so can the size of the envelopes. Therefore, the distance between extending arms 538 holding fingers 534 of feeding guide 454 can be changed. The outer extending arms 538A can be adjusted along positioning rod 536 of feeding guide 454 to adjust for different sized envelopes. Inner extending arms 538B can be fixed in a position along positioning rod 536 at distances $D_{F2}$ to permit smaller envelopes to be processed, while at the same time allowing insertion pusher members to pass between fingers 534B and not interfere with the insertion process. For the larger envelopes, outer extending arms 538 can be moved to the distance $D_{F1}$ to properly hold open a larger envelope such as a flats envelope. For the smaller envelopes, outer extending arms 538B can be moved in such that fingers 534A abut against fingers 534B of outer extending arms 538B.

To further facilitate insertion of insert material into the envelope, extending tabs 432 can be placed on the inside of both insert guides 430 such that the tabs 432 extend pass second end 414 of deck 410 to a point where tabs 432 would reside under the flap portion of the envelope in the insertion position without extending into the mouth or under the back side of the body portion of the envelope. Tabs 432 on upstream end 433 can be secured on a top end 431 of the insert guides 430 such that tabs 432 extend above top 416 of deck 410 and parallel slots 420 where the insert materials pass along conveying path 418. Thus, the insert material passes under tabs 432 as it travels down the path 418. Since the downstream end 435 of tabs 432 extend under the flap of the envelopes, the tabs 432 help further prevent the insert material from catching the flap of the envelope as the insert material is inserted into the envelope.

As mentioned above, to help increase the efficiency of the filling of envelopes with insert material, deck 410 and feeding guide 454 are adjustable between different locations within variable envelope opener apparatus 400. This adjustability allows the envelope to be held open in varying amounts depending on the characteristics of the insert material, such as the amount of material to be inserted into the envelope. Referring back to FIG. 3, variable envelope apparatus 400 includes deck 410 to which feeding guide 454 is attached. This deck 410 is adjustable to regulate the amount the mouth of an envelope is held open when in the insertion position. The mouth of an envelope can be held open in a wider stance when a greater amount of insert material is to be received in the envelope. Conversely, the mouth of an envelope can be held open in a narrower stance when the amount of insert material to be inserted in the envelope is smaller than the specified amount.

As a further consideration, the extent to which the mouth of the envelope is opened can vary based on the amount of clearance between the interior side walls or folds of the body portion BP of an envelope E relative to the respective width of the insert materials. This is due to the increased contraction of sides of the envelope as the mouth is widened. As a result, the envelope becomes less flat, forcing the interior walls or folds of the envelope E to encroach upon the sides of the insert material within, and ultimately contract the insert materials as opposed to keeping them in a generally planar position. When contraction of the insert materials or corresponding envelope E occurs, this can result in jams during processing.

Consider, for example, a scenario wherein a first set of insert materials have physical characteristics that enable 0.5 inches of interior side-to-side clearance (e.g., 0.25 inches per side) upon insertion into the envelope E, while a second set of insert materials to be placed within the same sized envelope E enables a clearance of 1 inch (e.g., 0.50 inches per side). Given the limited clearance space, the mouth for the envelope accommodating the first set of materials cannot be opened as wide as the envelope E for the second set while still maintaining a generally planar position. The relative distance available before encroachment of the interior side walls or folds of the envelope E upon the sides of the insert material impact how wide the mouth may be opened.

Clearance distances may be manually specified in advance of processing of the sheet articles through the inserting system IS. This information may then be relayed to controller 600 for controlling the positioning of deck 410 and feeding guide 454 for enabling variation in the amount of opening of the mouth of the envelope E. Alternatively, the available interior side clearance may be detected during processing of an envelope via the usage of one or more proximity or distance sensors, which may be embedded within the extending arms 538 and fingers 534 of feeding guide 454 for providing feedback information to the controller 600 for deck 410 and feeding guide 454. Those skilled in the art will recognize that various other means for determining available clearance information due to insertion may be applied.

FIG. 11 shows the perspective view of deck 410 along with feeding guide 454 attached thereto. As pointed out above, deck 410 has top side 416 that provides conveying path 418 on which insert material travels toward the envelope in which it shall be inserted as described above. Deck 410 includes first end 412 and second end 414. First end 412 is positioned in an upstream position in the inserting station. Deck 410 can pivot about first end 412. For example, a hinge 544 can be secured to first end 412 of deck 410 to permit deck 410 to pivot about hinge 544. Feeding guide 454 is attached to deck 410 underneath second end 414. Feeding guide 454 resides in a feeding guide frame 546. Feeding guide frame 546 is secured to an underside portion of deck 410 such that fingers 534 of feeding guide 454 are proximal to second end 414 of deck 410.

An adjustment mechanism, generally designated as 550, can be secured to the underside of deck 410 and also to a portion of frame 548 of insertion system IS. Adjustment mechanism 550 can be a deck actuator 552 that can be pneumatically controlled to pivot deck 410 about hinge 544. As deck 410 pivots about a pivot point of hinge 544, conveying path 418 and feeding guide 454 raise and lower. In this manner, the placement of fingers 534 in relation to first holding device 522 as well as second holding device 524 can be changed depending on how deck 410 is pivoted about hinge 544.

Figure 12:
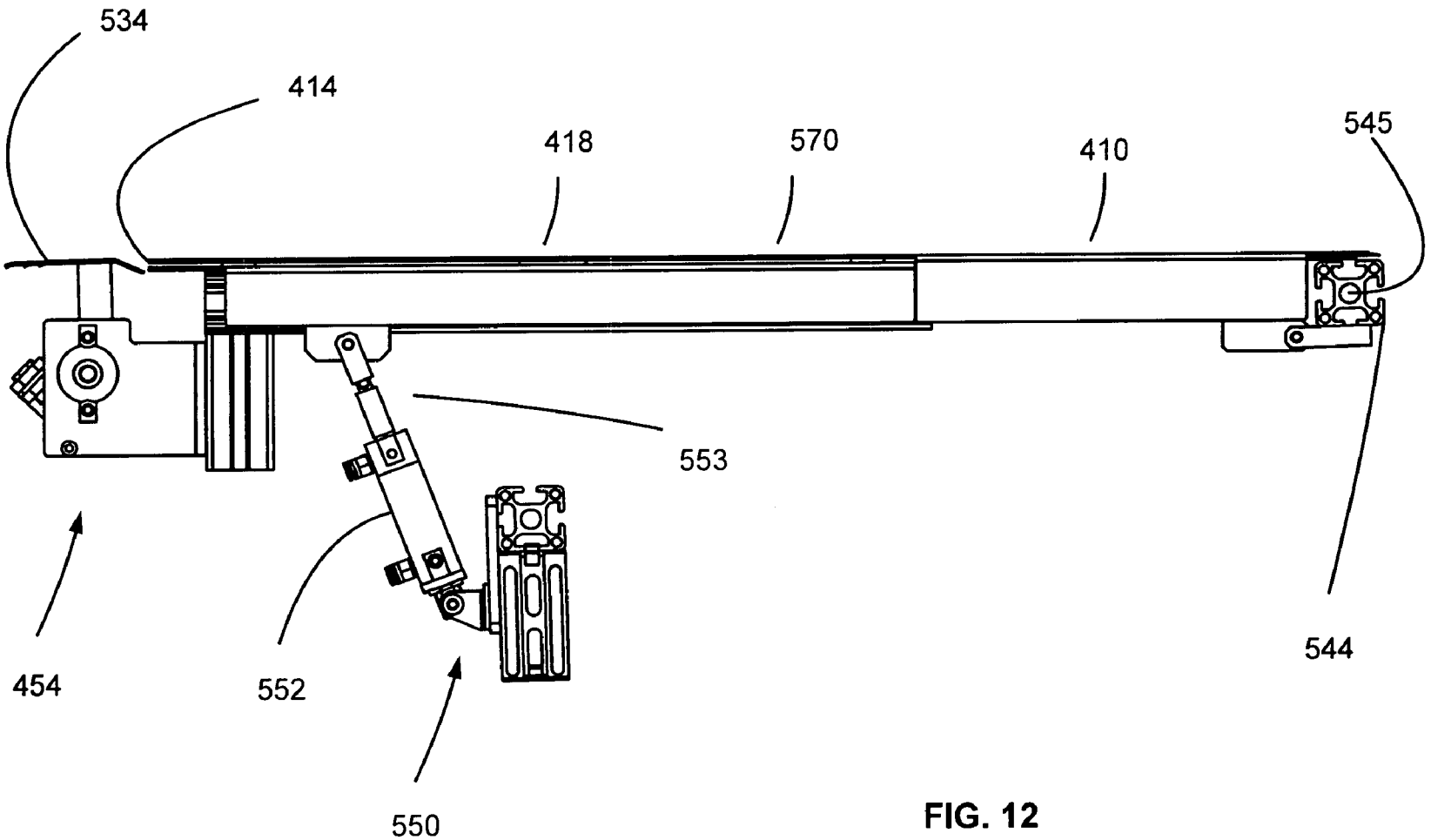
FIG. 12 illustrates a side view of the deck of the variable envelope opener apparatus according to FIG. 3 in a lower location.
Figure 13:
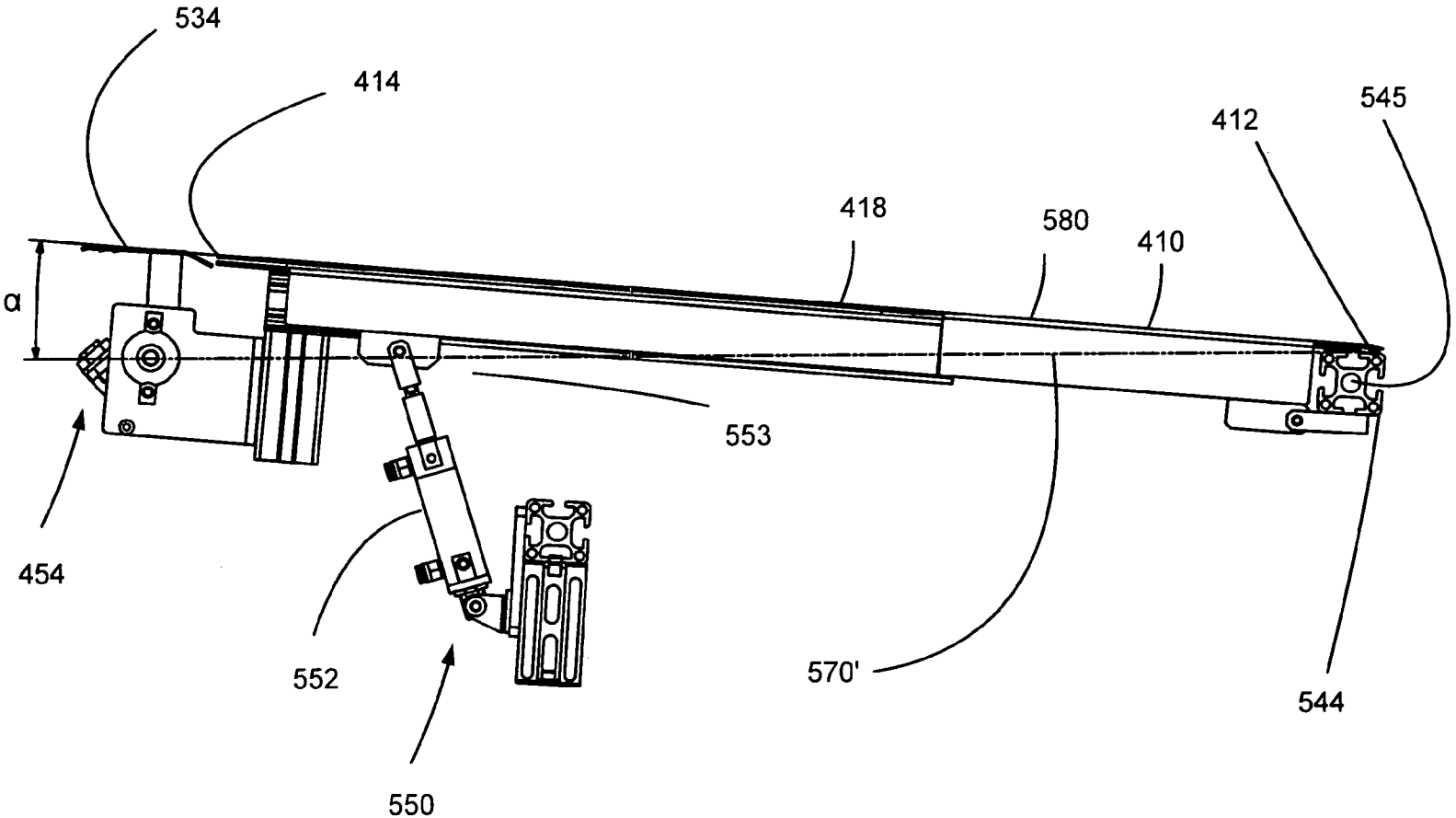
FIG. 13 illustrates a side view of the deck of the variable envelope opener apparatus according to FIG. 3 in an upper location.

As it can be seen in FIGS. 12 and 13, deck 410 can be moved on at least one end between one of at least two locations. For example, in FIG. 12, deck 410 can be in a lower location 570 to accommodate insertion of a greater amount of material into an envelope. The positioning of the lower location 570 is determined based on the size of the envelope in which the material is to be inserted and the characteristics of the material to be inserted into the envelope. In the lower location 570, deck 410 is positioned so that fingers 534 hold the mouth of the envelope in a stance that maximizes the success rate of insertion of the material into the envelope. Each location of the deck 410 permits fingers 534 to open the envelopes wide enough for insert material to be safely inserted into the envelope, while, at the same time, preventing the envelope to be open so wide that it causes the side walls of the envelope to overly contract thereby possibly limiting the ability of the insert material to be inserted into the envelope. The rotation of deck 410 about pivot point 545 of hinge 544 can vary depending on the amount of material to be inserted and the envelope being filled. Normally, deck 410 can rotate approximately about 1.5 degrees. The shorter the deck 410, the larger the angle is that it can pivot.

Deck 410 can be raised to an upper location 580 as shown in FIG. 13, when smaller envelopes are used and/or a lesser amount of insert material is to be inserted in the envelope. To change the location of the deck, the actuator 552 can extend an arm 553, thereby rotating deck 410 upward about pivot point 545 of hinge 544 at the first end 412 by an angle $\alpha$ causing the second end 414 to extend upward from the plane 570' in which deck 410 resided in its lower location 570 shown in FIG. 12. As the second end 414 is moved upward, feeding guide 454 also moves. Thus, when deck 410 and feeding guide 454 are in the upper location 580, the mouth of the envelope will be held open in a narrower stance than when deck 410 and feeding guide 454 are in the lower location 570.

Figure 14:
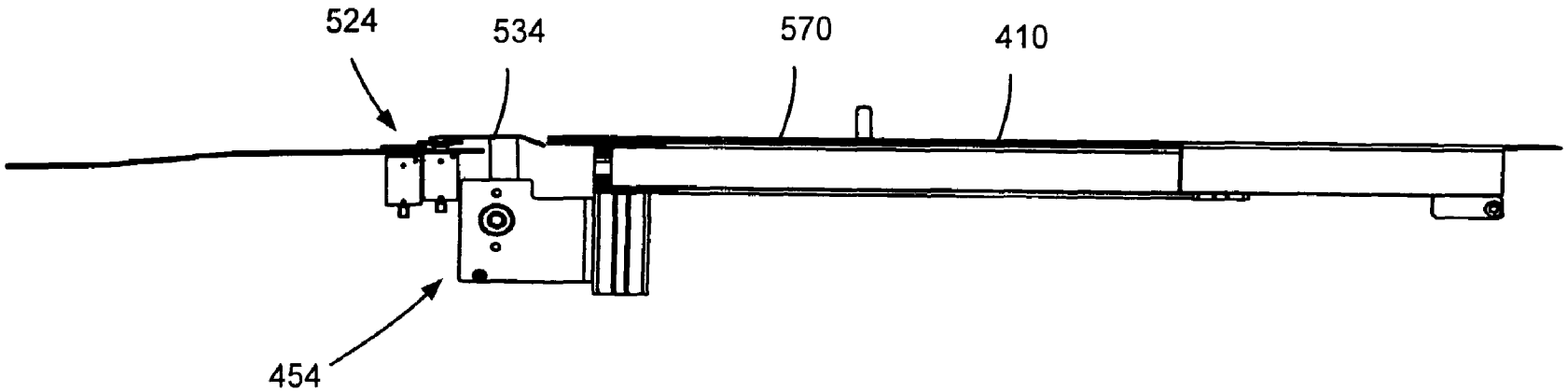
FIG. 14 illustrates a side view of the deck of the variable envelope opener apparatus according to FIG. 3 in a lower location.
Figure 15:
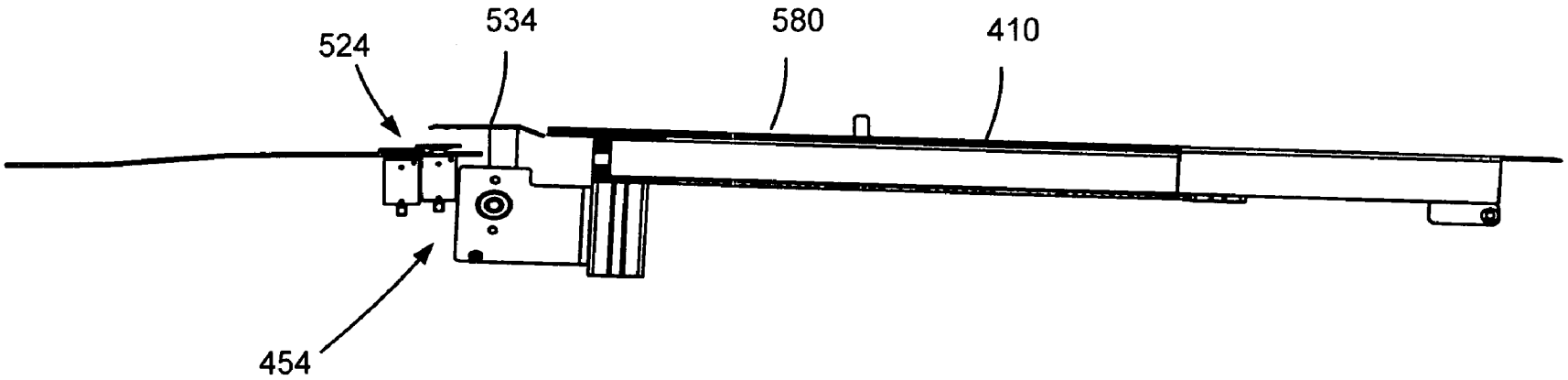
FIG. 15 illustrates a side view of the deck of the variable envelope opener apparatus according to FIG. 3 in an upper location.

FIGS. 14 and 15 show deck 410 and feeding guide 454 in the lower location 570 and upper location 580 in relation to second holding device 524 of holding system 520. In FIG. 14, deck 410 is in lower location 570 and feeding guide 454 is rotated into its engaged position. Fingers 534 are close to second holding device 524 and farther away from the first holding device (not shown in FIG. 14). Thus, once second holding device 524 releases the envelope, fingers 534 and the first holding device will hold the device open in a wide stance. In FIG. 15, deck 410 is in upper location 580 and feeding guide 454 is rotated into its engaged position. Fingers 534 are farther away from second holding device 524 and closer to the first holding device (not shown in FIG. 15) than when deck 410 and feeding guide 454 are in lower location 570. Thus, once second holding device 524 releases the envelope, fingers 534 and the first holding device will hold the envelope open in a narrower stance.

The information to determine the placement of deck 410 can be provided by controller 600, which is used to control the inserting station as well as other modules within the inserting system. This information may relate to the characteristics of the insert material. For example, this information may include, but is not limited to, size and weight information relating to the insert material. The controller 600 can decide how wide that the mouth of each envelope should be held open to insert the material to be received based on the amount of material to be inserted. Controller 600 can shift deck 410 and feeding guide 454 into different locations based on information it has received or based on calculations the controller 600 has made. For example, controller 600 can receive measurement information from sensors within the inserting system about size and weight information relating to the insert material.

Controller 600 can receive the information from program job information that is loaded into the controller either by an operator or through some information transfer mechanism. Such program job information contains information about each set of mailings to be sent out. A mailing can comprise anywhere from one to hundreds of thousands of filled envelopes. The program job information that is used to determine the positioning of deck 410 can include such information as a number of sheets in a set or information regarding the weight of a single sheet within a set or the number of sets to be inserted in each envelope to be included in an envelope. Further, the program job information can include the types of sheet articles or mail articles to be inserted.

Such information used by the controller can be associated with specific addressees. For example, the amount of material can be tied to the specific address to which the materials are to be sent. For instance, bar codes on sheets of the document sets being collated within a collector upstream can be read by a reader R (as shown in FIG. 1) to determine how that document set and other insert material will be accumulated for insertion. Such information can be used by the controller to determine the positioning of the deck 410 and feeding guide 454. Further, bar code information read off the envelope coming into the insertion station can help to determine the positioning of deck 410.

Operators can also determine the positioning of the deck such that the changing of deck 410 can be done based on a single set of jobs where deck 410 stays in one position for the whole series of mailings or, can change variably within a single job based on the information provided by an operator or by information entered or collected as program job information and/or bar code information about grouping of insert material. For example, the controller 600 can be programmed to allow deck 410 to be raised or lower based on a set number of envelopes to be filled as programmed by the operator.

Alternatively, when a reader R scans the bar code of a sheet or an envelope it can determine what inserts are needed for that envelope and adjust deck 410 accordingly when the insert material that is collected is ready to be inserted into that designated envelope. In this way, the width at which the mouth of the envelope is held open is variable. The width at which an envelope is held open can thus be maximized to increase the efficiency of the inserting system. The controller used to control the adjustment of deck 410 between the different locations can be a localized controller in communication with controller 600 or can be a manually activated.

Controller 600 can be a programmable device or devices such as one or more computers or mini-computers and it can run specific software programs or be hard wired to specifically perform the functions of the inserting station including the raising and lowering of deck 410 and feeding guide 454 to optimize the width at which the mouth of the envelope is held open for insertion of the insert material.

For example, for a job set, the deck 410 can assume the position as shown in FIGS. 12 and 14 where a larger amount of insert material will be inserted into an envelope. At this point, actuator 552 of the adjustment mechanism 550 pulls deck 410 into a lower location 570 such that deck 410 pivots downward around pivot point 545 about hinge 544. At this location, the feeding guides 534 can be in closer relationship to second holding device 524 and farther away from the first holding device (not shown in FIGS. 12 and 14), thereby holding the envelope mouth open in a wider stance to allow insertion of the larger amount of material. If the next set of jobs is for a smaller envelope or contains less insert material to be inserted, then actuator 552 can extend to pivot deck 410 and feeding guide 454 upward about pivot point 545 in hinge 544 such that deck 410 rises at the second end 414 as shown in FIGS. 13 and 15 to a upper location 580. At this location 580, feeding guides 534 can be farther away from second holding device 524 and closer to the first holding device (not shown in FIGS. 13 and 26) thereby holding the envelope mouth open in a narrower stance to allow insertion of the smaller amount of material. As discussed above, the amount which the second end 414 can move varies depending on the length of deck 410, the size and type of the envelopes being processed, the characteristics of the material being inserted, or the like. For example, the changing of the location of the fingers 534 can be from about 1 mm up to about 30 mm or more depending on the characteristics of the insert material to be inserted and the size and/or type of the envelopes being processed.

Since the amount that deck 410 is rotated about hinge 544 can be partly determined by the size of the envelopes and the amount of insert material to be inserted into the specified envelopes, deck actuator 552 can be capable of rotating deck 410 into multiple different locations to accommodate for different size envelopes, different amounts of material, or the like.

Figure 16:
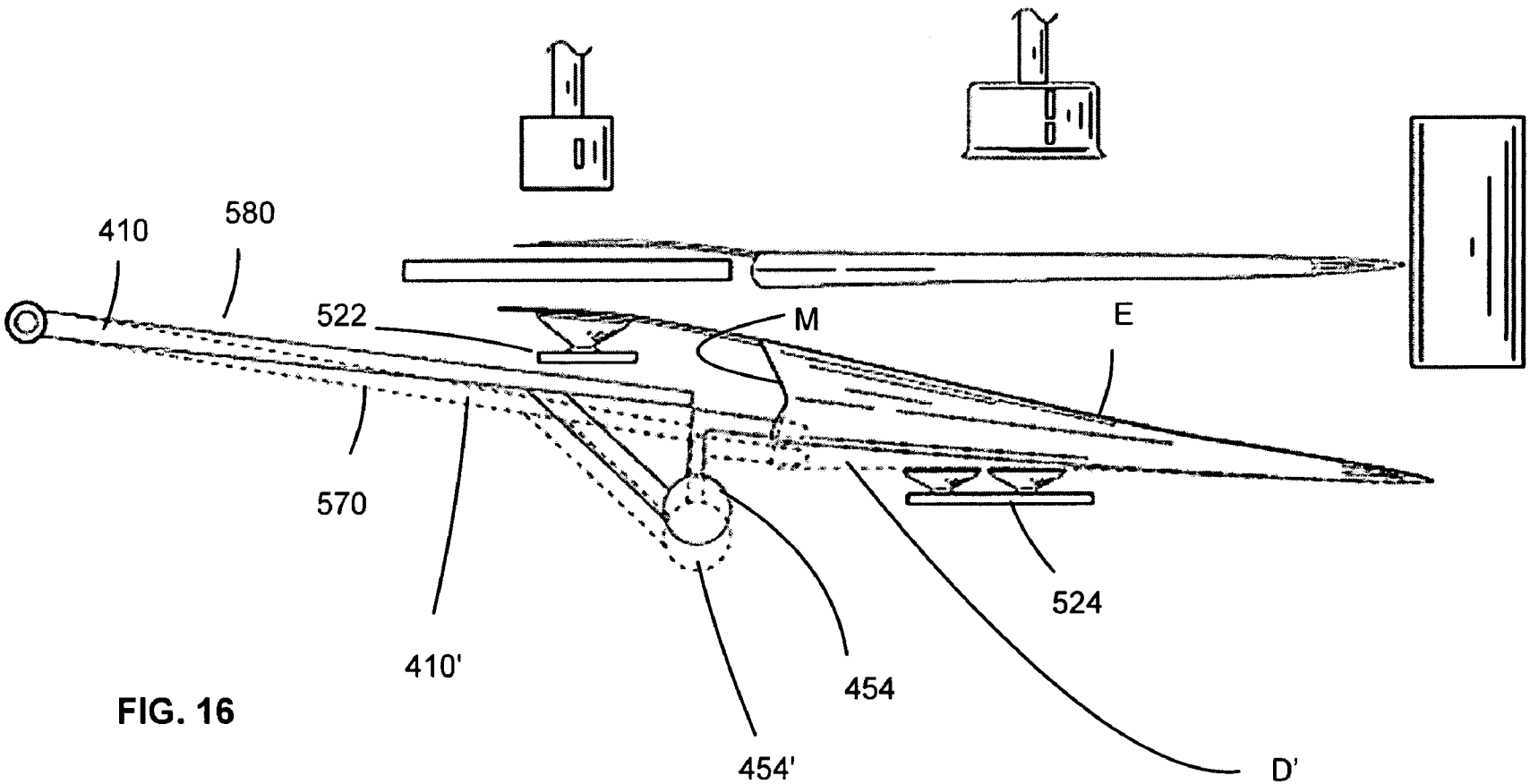
FIG. 16 illustrates a schematic side view of a variable envelope opener apparatus with envelopes being processed according to the present subject matter.

FIG. 16 shows a schematic view of variable envelope opener apparatus 400 with a deck 410 and feeding guide 454 in an upper location 580. The fingers 534 of feeding guide 454 hold mouth M of an envelope E open in a narrower stance. Further, FIG. 16 shows a phantom view of deck 410 and feeding guide 454 being in a lower location 570 with fingers 534 holding the envelope in a wider position.

Figure 17A:
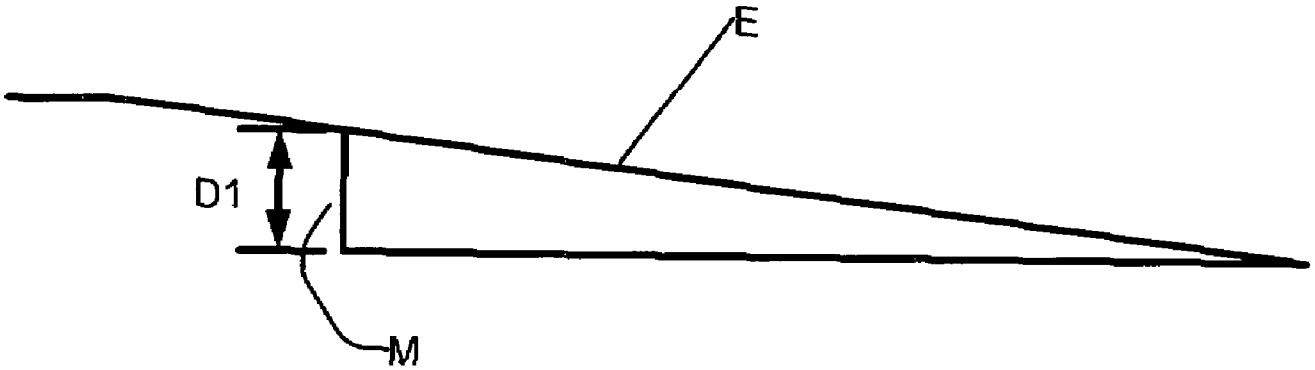
FIGS. 17A and 17B illustrate schematic side views of an envelope being held open at different widths by the dynamic envelope opener apparatus according to FIG. 16.

For inserting a lesser amount of material into an envelope, deck 410 can be moved to upper location 580 closer to first holding device 522 such that fingers 534 of feeding guide 454 secured to deck 410 hold mouth M of envelope E in a narrower stance as shown in FIG. 17A. In this manner, mouth M of envelope E is held open at a distance $D_1$ that does not cause much contraction of the sides of the envelope, while still permitting a large enough distance for the intended insert material to be inserted easily into the envelope. Thus, neither the width that the envelope is opened nor the contraction of the sides will interfere with the insertion process. Thereby, the success rate for the insertion of the material into the envelope can be increased.

Figure 17B:
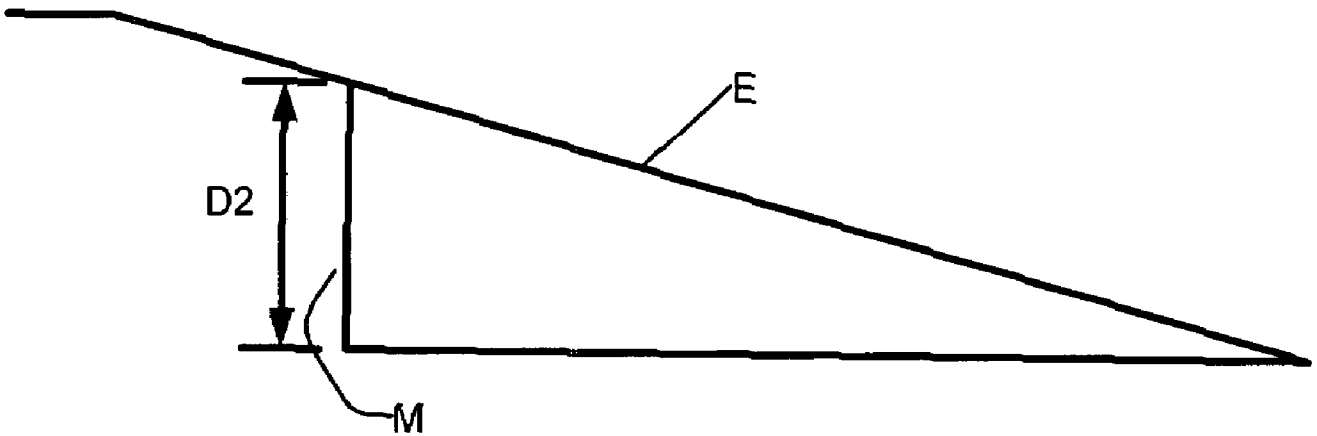

If it is determined that a larger amount of material is to be inserted into an envelope, the deck 410 can be shifted to lower location 570 shown in phantom in FIG. 16 such that deck 410 and feeding guide 454 assume location 410' and 454', respectively. Such a location 570 is further away from first holding device 522. Thus, the envelope will be held in a wider stance as shown in FIG. 17B where mouth M of envelope E is held open at a greater distance. By holding the envelope at a greater distance $D_2$ due to the shifting of the deck 410 to the lower location 570, the sides of envelope E will contract more than if envelope E is held at a distance $D_1$. However, the success rate of insertion can be increased due to the increased width at which the mouth of the envelope is held open, since a larger amount of insertion material is being inserted into the envelope. In this manner, the versatility of inserting station 300 and inserting system IS can be increased by allowing a variable change of position of the envelope opener apparatus depending on the amount of material to be inserted.

The embodiments of the present disclosure shown in the drawings and described above are exemplary of numerous embodiments that can be made within the scope of the appending claims. It is contemplated that the configurations for variably opening envelopes within a sheet processing machine can comprise numerous configurations other than those specifically disclosed. The scope of a patent issuing from this disclosure will be defined by the appended claims.

What is claimed is:

1. A method for adjusting an opening of an envelope within an inserting system, the method comprising:

(a) advancing insert material to a deck and toward an envelope for insertion of the insert material into the envelope; and (b) opening a mouth of the envelope to an open position dependent upon physical characteristics of the insert material to be inserted into the envelope by adjusting a position of a deck to regulate an amount that the mouth of the envelope is opened.

2. The method according to claim 1, wherein the mouth of the envelope can be opened into multiple open positions.

3. The method according to claim 1, wherein the opening step includes adjusting a position of a feeding guide that holds open a mouth of each envelope to control the amount that the mouth of each envelope is held open based on information about the size or the interior side clearance space available upon insertion of the insert material into the envelope.

4. The method according to claim 3, further comprising receiving an envelope in an insertion position.

5. A method for adjusting an opening of an envelope within an inserting system, the method comprising:

(a) advancing insert material toward an envelope for insertion of the insert material into the envelope; and (b) opening a mouth of the envelope to an open position dependent upon physical characteristics of the insert material to be inserted into the envelope by adjusting a position of a deck that provides a conveying path on which the insert material travels and adjusting a position of a feeding guide that holds open a mouth of each envelope to control an amount that the mouth of each envelope is held open based on information about size or interior side clearance space available upon insertion of the insert material into the envelope; and (c) receiving an envelope in an insertion position and rotating the feeding guide into the mouth of the envelope.

6. A method for adjusting an opening of an envelope within an inserting system, the method comprising:

(a) advancing insert material toward an envelope for insertion of the insert material into the envelope; and (b) opening a mouth of the envelope to an open position dependent upon physical characteristics of the insert material to be inserted into the envelope by adjusting a position of a deck that provides a conveying oath on which the insert material travels and adjusting a position of a feeding guide that holds open a mouth of each envelope to control an amount that the mouth of each envelope is held open based on information about size or interior side clearance space available upon insertion of the insert material into the envelope; and (c) wherein adjusting the positions of the deck and feeding guide further comprises rotating the deck about a hinged end of the deck.

7. The method according to claim 6, wherein the deck is rotated downward thereby moving the feeding guide into a lower location to hold the opening of the mouth of the envelope in a wider stance for receipt of the insert material.

8. The method according to claim 6, wherein the deck is rotated upward thereby moving the feeding guide into an upper location to hold the opening of the mouth of the envelope in a narrower stance for receipt of the insert material.

9. A method for adjusting an opening of an envelope within an inserting system, the method comprising:

(a) advancing insert material toward an envelope for insertion of the insert material into the envelope; and (b) opening a mouth of the envelope to an open position dependent upon physical characteristics of the insert material to be inserted into the envelope by adjusting a position of a deck that provides a conveying path on which the insert material travels and adjusting a position of a feeding guide that holds open a mouth of each envelope to control an amount that the mouth of each envelope is held open based on information about size or interior side clearance space available upon insertion of the insert material into the envelope;

(c) receiving an envelope in an insertion position; and (d) rotating the feeding guide into the mouth of the envelope in the insertion position.

10. The method according to claim 9, further comprising opening and holding the mouth of the envelope for insertion of the feeding guide therein before the step of rotating the feeding guide into the mouth of the envelope.

11. The method according to claim 10, further comprising releasing a portion of the envelope below the feeding guide after the step of rotating the feeding guide into the mouth of the envelope.

12. The method according to claim 11, further comprising conveying the insert material along the conveying path through insert guides on the deck, over the feeding guide and into the envelope.

13. The method according to claim 11, further comprising holding a second envelope in a staging position above the insertion position.

14. The method according to claim 11, further comprising moving a second envelope to the insertion position after placing the insert material in the envelope in the insertion position and conveying the envelope downstream.

15. A method for adjusting an opening of an envelope to accommodate insert material within an inserting system, the method comprising:

(a) advancing insert material along a deck toward an envelope for insertion of the insert material into the envelope;

(b) adjusting a position of the deck and a feeding guide attached to the deck to move the deck and the feeding guide to desired locations to regulate an amount that the mouth of the envelope is opened;

(c) adjusting the feeding guide from a retracted position to an engaged position to hold the mouth of the envelope in an open position; and (d) wherein the mouth of the envelope is held open an amount dependent on the physical characteristics of the insert material.

16. A method for adjusting the opening of one or more envelopes to accommodate different amounts of insert material within an inserting system, the method comprising the steps of:

(a) determining the amount of insert material to be inserted into each envelope of the one or more envelopes; and (b) adjusting the position of a deck that provides a conveying pathway on which the insert material travels and a finger guide relative to an insertion position for the one or more envelopes to control the amount that the mouth of each envelope is held open based on the determined amount of insert material;

(c) receiving an envelope in the insertion position;

(d) opening and holding the mouth of the envelope for insertion of the finger guide therein;

(e) rotating the finger guide into the mouth of the envelope in the insertion position;

(f) releasing a portion of the envelope below the finger guide; and (g) conveying the insert material along the conveying pathway on the deck, over the fingers guides and into the envelope.

* * * * *